US006413019B1

(12) United States Patent
Coombs et al.

(10) Patent No.: US 6,413,019 B1
(45) Date of Patent: Jul. 2, 2002

(54) TURRET ROCK BOLTER WITH STINGER/CENTRALIZER

(75) Inventors: Perry L. Coombs, Claremont; Paul R. Bigoney, Newport; Ward D. Morrison, Claremont, all of NH (US)

(73) Assignee: Oldenburg Cannon, Inc., Claremont, NH (US)

( * ) Notice: Subject to any disclaimer, the term of this patent is extended or adjusted under 35 U.S.C. 154(b) by 0 days.

(21) Appl. No.: 09/691,736

(22) Filed: Oct. 18, 2000

Related U.S. Application Data

(60) Provisional application No. 60/160,670, filed on Oct. 21, 1999.

(51) Int. Cl.[7] ..... B23Q 7/10; E21D 20/00; E21D 23/08

(52) U.S. Cl. ..... 405/303; 405/259.1; 175/52; 173/38; 173/39; 81/55; 29/809

(58) Field of Search ..... 405/258.1–259.6, 405/303; 175/52; 173/38–42; 81/55; 29/809

(56) References Cited

U.S. PATENT DOCUMENTS 4,473,325 A 9/1984 Beney et al. ..... 405/303
4,497,378 A 2/1985 Beney et al. ..... 173/32
5,114,279 A 5/1992 Bjerngren et al. ..... 405/303
5,246,313 A * 9/1993 Combet et al. ..... 405/303
5,556,235 A 9/1996 Morrison et al. ..... 405/303

* cited by examiner

*Primary Examiner*—Thomas B. Will
*Assistant Examiner*—Tara L. Mayo
(74) *Attorney, Agent, or Firm*—Michael J. Weins; Jeffrey E. Semprebon

(57) ABSTRACT

A rock bolter has a drill and a bolt driver, both mounted to a turret that rotates relative to a base to align either the drill or the bolt driver with a work axis. A stinger/centralizer has two head elements, each advanced along a curvilinear path. When advanced, the head elements mate to provide a centralizer passage on the work axis. A supplementary stinger affixed to the base extends to engage the rock surface and provide stability as the head elements are retracted. The drill and the bolt driver are mounted on carriages activated by a common mechanism. A drill carriage disabling surface is affixed to the base to block the drill carriage when the drill is off the work axis, and a bolt driver carriage disabling surface is affixed to the base to block the bolt driver carriage when the bolt driver is off the work axis.

22 Claims, 16 Drawing Sheets

TURRET ROCK BOLTER WITH STINGER/CENTRALIZER

This application claims benefit of Provisional Application No. 60/160,670 filed Oct. 21, 1999.

FIELD OF THE INVENTION

The present invention relates to a rock bolting device for drilling holes and setting bolts into the drilled holes. More particularly, it is for a rock bolter having dual feed tracks which are mounted on a turret which selectively rotates the feed tracks to a work position where they are sequentially utilized for bolt hole drilling and bolt setting.

BACKGROUND OF THE INVENTION

A variety of rock bolters have been developed to drill holes and set bolts to stabilize rock walls. These rock bolters can be subdivided into single feed track and dual feed track rock bolters. U.S. Pat. No. 5,114,279 discloses a single feed shell rock bolter where a rock drill and a bolt driver are sequentially fed on to the feed track, which forms a work position for the rock drill or the bolt driver. Either the rock drill or the bolt driver, depending on which is positioned on the feed shell, can be advanced to a rock surface into which a bolt is to be set. U.S. Pat. Nos. 4,473,325 and 4,497,378 disclose a dual feed track rock bolter. One of the feed tracks directs a rock drill as it advances toward a rock surface into which the bolt is to be set, while the other feed track directs a bolt driver as it is advanced toward the rock surface to set the bolt. The dual feed tracks are sequentially rotated to a work position and, when so positioned, the rock drill or bolt driver residing thereon can be advanced to the rock surface.

All of these rock bolters employ a stinger which engages the rock surface to stabilize the track(s) on which the rock drill and/or the bolt driver resides as they are advanced to the rock surface into which bolt holes are to be drilled and into which the bolts are to be set. One of the problems with bolt setting is locating the hole which has been drilled. A centralizer is preferably employed, which swings over the hole which has been drilled to guide the bolt as it is advanced toward the bolt hole to reduce the problem of locating the bolt hole. One difficulty with these types of bolt aligning systems is that of accurately positioning the centralizer with respect to the hole into which the bolt is to be set. This problem has been overcome by employing a common stinger/centralizer that is the subject matter of U.S. Pat. No. 5,556,235, which is assigned to the assignee of the present application.

Another complicating factor in drilling holes and inserting bolts into a rock surface is that frequently the rock surface into which bolts are being set is uneven. This severely limits the ability to position the rock bolter in close proximity to the rock surface and limits the work space available for movement of components of the rock bolter which reside near the rock surface when the rock bolter is positioned to set bolts. These problems are addressed in the '235 patent by employing a single stationary feed shell in combination with a magazine that is set back from the rock surface, which advances each bolt toward the rock surface as the bolt moves to the magazine position where it is to be picked up by the bolt driver. While this approach reduces the space required by the rock bolter in the vicinity of the rock surface, one difficulty with this approach is that the bolts are subject to transverse forces as they are advanced in the magazine, which can result in bending the bolts.

Another problem, which can occur when drilling into a friable rock, is that rock chips can fall into and impair the operation of the transfer and locking system which is used to transfer and secure the rock drill and the bolt driver on the feed track. This latter problem can be reduced by employing a turret dual feed track system such as is disclosed in the '325 and the '378 patents. However, the turret of the '325 patent is designed such that the feed tracks are in close proximity to the rock surface into which the bolts are set at all times during the rock drilling and bolt setting operations. This close proximity of the feed tracks sweeps out a large area of the rock surface and would not be effective for use with uneven rock surfaces. This problem has been reduced by the '378 patent, which teaches translating the turret along the work axis, allowing the turret to rotate when the feed tracks are more generously spaced from the rock surface. However, this additional clearance is obtained at the expense of increased complexity and increased length of the rock bolter. This increase in size complicates operation when operating in a mine shaft, and may prohibit operation in smaller shafts.

Thus, there is a need for a rock bolter that is compact and capable of readily drilling holes and setting bolts in uneven and friable rock surfaces.

OBJECTS OF THE INVENTION

It is an object of the present invention to provide a dual feed track rock bolter with a stinger/centralizer.

It is another object of the invention to provide a dual feed track rock bolter which requires a limited work space at the rock surface while maintaining a reasonably short overall length of the rock bolter.

It is another object of the invention to provide a compact dual feed track rock bolter utilizing a stinger/centralizer and employing a bolt magazine which rotates about a central magazine axis.

It is a further object of the invention to provide a supplementary stinger for a rock bolter that employs a stinger/centralizer which stabilizes the rock bolter as the stinger/centralizer is being disengaged from the rock surface.

It is still a further object of the invention to provide a drill steel retaining ring for a rock bolter employing a stinger/centralizer which focuses the motion of the drill steel tip to promote its engagement with the stinger/centralizer as the drill steel is advanced.

It is yet another object of the invention to provide a stinger centralizer which has a first head arm and a second head arm, one of which is advanced on a path where its associated head element moves along a non-linear path as it advances toward and retracts from the rock surface.

It is a further object of the invention to provide a dual feed track rock bolter having a bolt magazine which rotates about a central axis such that, when the turret is positioned with the rock drill feed track in the work position, the bolts in the magazine may be advanced into a position alignable with a bolt driver axis.

It is a further object of the invention to provide a dual feed track rock bolter having a locking mechanism to immobilize whichever of the rock drill and the bolt driver is not positioned on the work axis.

It is a further object of the invention to provide a dual feed track rock bolter having a frusto-conical bolt magazine.

It is a further object of the invention to provide a dual feed track rock bolter having bolt-engaging hands which maintain a bolt, which is initially substantially in line with the bolt driver axis, so aligned while the bolt driver feed track is swung into the work position.

SUMMARY OF THE INVENTION

The present invention, in a rudimentary form, provides a dual feed track rock bolter which has a stinger/centralizer symmetrically disposed about a work axis along which both a drill steel and a rock bolt are sequentially advanced. The dual feed track rock bolter has a drill feed track, which is traversed by a rock drill having an associated drill axis and carrying the drill steel aligned with the drill axis, and a bolt driver feed track, which is traversed by a bolt driver having an associated bolt driver axis and carrying the bolt aligned with the bolt driver axis. Both of the feed tracks are mounted on a turret which in turn is rotatably mounted to a base which also supports the stinger/centralizer. The base in turn is attached to a boom which is attached to a carrier vehicle, the boom serving to position the base and turret with respect to a rock surface into which the bolt is to be set.

The turret rotates about a turret axis which is parallel to but displaced from both the drill axis and the bolt driver axis. The turret is rotatable between a drilling position, where the drill feed track resides in a work position and the drill axis is aligned with the work axis, and a bolt setting position, where the bolt driver feed track resides in the work position and the bolt driver axis is aligned with the work axis. As designed, the rock bolter is well suited to be used in combination with a bolt magazine which positions a bolt on the bolt driver axis when the drill feed track is in the work position.

The stinger/centralizer of the dual feed track rock bolter of the present invention has a first head element, with a first head cavity and a rock engaging surface. The first head element is mounted on a first head arm which movably engages a first head arm mount which is in turn attached to the base and can be made an integral part thereof. It is preferred that the first head arm mount be located in close proximity to the boom to which the base mounts, thereby reducing the moment on the boom when the first head element engages the rock surface. The motion of the first head arm with the first head arm mount is coordinated such that the first head element traverses a curvilinear path (a path composed of one or more curved and/or linear segments) to and from an extended position. Preferably, the first head element traverses a substantially linear path. It is further preferred that the first head arm be substantially a straight arm, and it is still further preferred that the straight arm be inclined with respect to the work axis of the stinger/centralizer by between 30 and 60 degrees. This limitation assures that a substantial portion of the force transmitted is normal to the rock surface when the first head element is engaged therewith. More preferably, the inclination of the first head arm is 45 degrees with respect to the work axis.

The stinger/centralizer also has a second head element with a second head cavity, which is mounted on a second head arm which movably engages a second head arm mount which is attached to the base and can be an integral part thereof. The movable engagement of the second head arm with the second head arm mount is coordinated such that the second head element traverses a curvilinear path as it approaches and moves away from an extended position, where it can be engaged with the first head element when the first head element is in its extended position. The second head arm is crooked so as to accommodate a bolt magazine and/or movement of the turret and feed tracks therebeneath while still providing a head arm which can be readily retracted. Similarly, the path traversed by the second head element as the second head element is advanced and retracted maintains clearance of the second head element and the second head arm with respect to the bolt magazine and/or the turret and feed tracks. Providing such a path for the second head arm facilitates the construction of a compact rock bolter.

Means for advancing and retracting the first head arm and the second head arm are provided, these means include such mechanisms as linear actuators, worm gears, and rack and pinion gears.

Also provided are means for guiding the first head arm and the second head arm along prescribed paths. Preferably, these means include spaced apart arm guide surfaces positioned on the head arms. These guide surfaces can be bounding surfaces for the arms or can be walls of tracks or slots internal to the arms. Accompanying these guide surfaces on the head arms are spaced apart directing elements provided in the head arm mounts or forming an integral part thereof. These directing elements can be formed by cams or rollers mounted to the head arm mounts, or by surfaces of passages through the head arm mounts. Similarly, the attachment of the guide surfaces and directing elements can be reversed, having the guide surfaces on the head arm mounts and the directing elements on the head arms. Through the cooperative efforts of the means for advancing and retracting and the means for guiding, the first and second head elements can be moved along prescribed paths best suited for use with particular surface characteristics of the rock surface.

In many preferred embodiments, it is preferred that first head arm be substantially straight and that the prescribed path of the first head arm be a linear path. Such is readily accomplished by having the first head arm be a straight arm which slidably engages a channel in the first head arm mount, in which case the bounding surfaces of the first head arm serve as the spaced-apart reference surfaces and the sidewalls of the channel serve as the directing elements.

Such a first arm configuration finds great utility when the rock bolter is designed for drilling holes and setting bolts both into rock surfaces which are relatively flat, as well as into those which are highly irregular and have substantial variation in elevation as a function of position.

In one preferred embodiment, designed for use where the rock surface into which holes are to be drilled is substantially flat, a second arm path can be provided by forming the second head arm as an arc which slidably engages the second head arm mount so as to provide a movement of the second head element which is substantially arcuate. In this embodiment, the motion of the second head element, when in close proximity to the rock surface, has a large component of motion parallel to the rock surface.

In other applications, designed for use where the rock surface is highly irregular, the second head arm and the second head arm mount are provided with spaced apart guide surfaces and direction elements which direct the second head arm along a complex path as the second head arm is advanced. The complex path taken by the second head arm is required to provide an appropriate movement of the second head element, since the irregular rock surface makes it impractical to move the second head element along a path where a large component of the motion is parallel to the rock surface when the second head element is in close proximity to the rock surface. The second head arm is configured with guide surfaces which contact and slidably engage cams on the second head arm mount to redirect the second head arm. Preferably, the guide surfaces of the second head arm and the cams are configured such that, when the second head element is retracted away from the rock surface, the motion of the second head arm has both translational and rotational components. It is further preferred for the motion to be controlled such that the second head element is advanced and withdrawn with a substantial component of motion normal to the rock surface when in close proximity to the rock surface. Alternative configurations to provide the desired complex motion include the use of a slot in the second head arm combined with a follower or roller mounted to the second head arm mount and which rides in the slot to provide the prescribed motion. To improve reliability when used in a mine shaft environment, it is preferred to provide a degree of looseness between the spaced apart guide surfaces and directing elements, in which case the exact path traversed by the second head element will depend, in part, on the orientation of the rock bolter.

Means are provided to engage the first head element with the second head element so as to assure that the first head element mates with the second head element such that the first head cavity and the second head cavity produce a combined head cavity traversing the fully engaged head elements. The first head cavity and the second head cavity are preferably configured such that, when the first head element is fully engaged with the second head element, the resulting combined cavity has a conical guide portion and a cylindrical centralizer passage.

It is further preferred that the first head element have a first head mating surface and that the second head element have a second head mating surface, and that these mating surfaces be substantially planar so that they can be brought into sliding contact along what becomes a planar interface.

It is also preferred that a stabilizing protrusion be provided which is fixably positioned with respect to one of the head elements, and have one or more protrusion guiding surfaces which are configured to engage one or more receptor guiding surfaces which are fixably positioned with respect to the other of the head element. When such a protrusion is employed, it is further preferred that the latter raised arm have means for stabilization of the arm such that the motion of the arm at all times remains parallel to a sweep plane. The protrusion guiding surfaces and the receptor guiding surfaces preferably lie in a plane substantially parallel to this sweep plane. To maintain the integrity of the conical guide portion and the cylindrical centralizer passage of the head assembly, it is further preferred that the planar interface between the head elements lie substantially perpendicular to the sweep plane.

Another feature which is preferably incorporated into the rock bolter of the present invention is a supplementary stinger which further stabilizes the feed tracks of the rock bolter. The supplemental stinger has a stinger body, which is affixed with respect to the base, and an extendable member, which engages the stinger body and terminates in a rock-engaging end. The stinger body is preferably mounted in close proximity to the boom. When the first head arm mount is in its preferred position in close proximity to the boom, the stinger body can be attached to the first head arm mount. The supplementary stinger maintains registry of the bolt driver axis with the bolt hole as the first head arm is being retracted. This reduces the bending moment on the bolt during its final stage of setting, which occurs while the first head element is disengaged from the rock surface to allow continued advancement of the bolt. While the supplementary stinger has utility for the dual feed shell rock bolter employing a stinger/centralizer of the present invention, such also has utility for single feed shell rock bolters which employ a stinger/centralizer.

It is also preferred for the rock bolter to provide support for the drill steel when the drill steel approaches the stinger/centralizer so as to direct the drill steel into the centralizer passage. To achieve this, it is preferred to employ a drill steel retaining ring which is mounted at a proximal end region of the drill feed track, which is in closest proximity to the stinger/centralizer. The drill steel retaining ring is either mounted to the drill track or pivotable about the turret such that, in either case, the drill steel retaining ring can be axially aligned with the drill axis. The dimensions of the drill steel retaining ring are selected in accordance with the length of the drill steel, the relative separation of the drill steel retaining ring from the stinger/centralizer, and the dimensions of the combined head cavity.

When the rock drill and the bolt driver are mounted on carriages which serve to move the rock drill and the bolt driver along their respective feed tracks, these carriages can be activated by a common carrier activation means which is shared between the two carriages. The selective activation of the carriage for the tool which is aligned with the work axis (the active tool) can be accomplished by immobilizing the carrier which resides off the work axis (the non-active tool). For this reason, it is preferred that a carriage stop member be attached to the base. The carriage stop member has a drill carriage disabling surface positioned to engage the drill carriage when the drill is the non-active tool, this engagement preventing advancement of the carriage along the drill feed track. Similarly, the carriage stop member has a bolt driver carriage disabling surface positioned to engage the bolt driver carriage when the bolt driver is the non-active tool and prevent advancement of the bolt driver carriage along the bolt driver feed track. This carriage stop member provides a simple mechanism which eliminates the necessity of having two feed track advancing mechanisms.

While the stinger/centralizer described above can be employed with a variety of bolt magazines, the rock bolter of the present invention has particular utility when used in combination with cylindrical-type bolt magazines having radially arranged bolt cradles which, in combination with bolt retaining rings, maintain the bolts in position. The bolt magazine has a magazine axis which is fixably positioned with respect to the turret axis. The magazine axis is aligned such that one of the bolt cradles of the bolt magazine is axially aligned with the bolt driver axis when the turret is in or near the drilling position. The bolt retaining rings are provided with bolt exit passages which allow a bolt positioned on the bolt driver axis to be withdrawn from the bolt cradle in which it resides.

Accompanying the bolt magazine are bi-modal bolt-engaging hands which are pivotably mounted to hand arms which in turn are affixed to the turret. The bolt-engaging hands are biased to toggle between a bolt-holding position, which is assumed when the turret is in the drilling position, and a bolt driver by-pass position, which is assumed when the bolt being driven is held by the bolt driver and the centralizer and which allows the bolt driver to pass the bolt-engaging hands. The bolt-engaging hands are configured to resiliently grip a bolt that is advanced thereinto when the magazine is advanced while the turret is in the drilling position. Means for toggling the bi-modal bolt-engaging hands are provided. It is preferred that the means for toggling have a linkage pivotably connected to the bolt-engaging hands to coordinate the toggling of the bolt-engaging hands, as well as a hand-deactivating protrusion attached to the bolt driver carriage and configured to forcibly engage one of the hands when the bolt driver has advanced to a position where the bolt being held therein is engaged with the centralizer. One or more toggling ramps are provided, which are fixed with respect to the turret axis and are configured to forcibly engage one or more of the bolt-engaging hands if they reside in the bolt driver by-pass position when the turret is pivoted from the bolt setting position to the drilling position.

It is further preferred that the cylindrical bolt magazine be a tapered bolt magazine to further reduce the footprint of the rock bolter in the vicinity of the rock surface. The tapered bolt magazine is frusto-conical in overall shape, having a base radius determined by the number of bolts and the space required between the bolts to accommodate associated bolt plates, and having a top radius which is determined only by the number and diameter of the bolts. The length of the bolts defines the side of the frusto-conical shape. The tapered bolt magazine is mounted with respect to the base such that the magazine axis is inclined with respect to the bolt driver axis. The position and inclination of the bolt magazine axis is such that the magazine sequentially advances the bolts to a terminal bolt position which is aligned with the bolt driver axis when the turret is in the drilling position.

BRIEF DESCRIPTION OF THE FIGURES

FIG. 7*a* illustrates the second head element fully extended and in close proximity to a rock surface. FIG. 7*b* illustrates the second head element in an intermediate stage of retraction which results from movement of the second arm which is substantially linear in character. FIG. 7*c* illustrates the second head element fully retracted, the motion between the intermediate stage of retraction and the fully retracted position having a substantial arcuate component.

FIG. 8*a* illustrates the second head arm where the second head element is in its fully extended position. FIG. 8*b* illustrates the second head arm in an intermediate position where a substantial portion of the motion has been arcuate motion. FIG. 8*c* illustrates the second head arm where the second head element in its fully retracted position.

In FIG. 10, the turret is positioned such that the carriage stop member blocks advancement of the bolt driver.

BEST MODE FOR CARRYING THE INVENTION INTO PRACTICE

Figure 1:
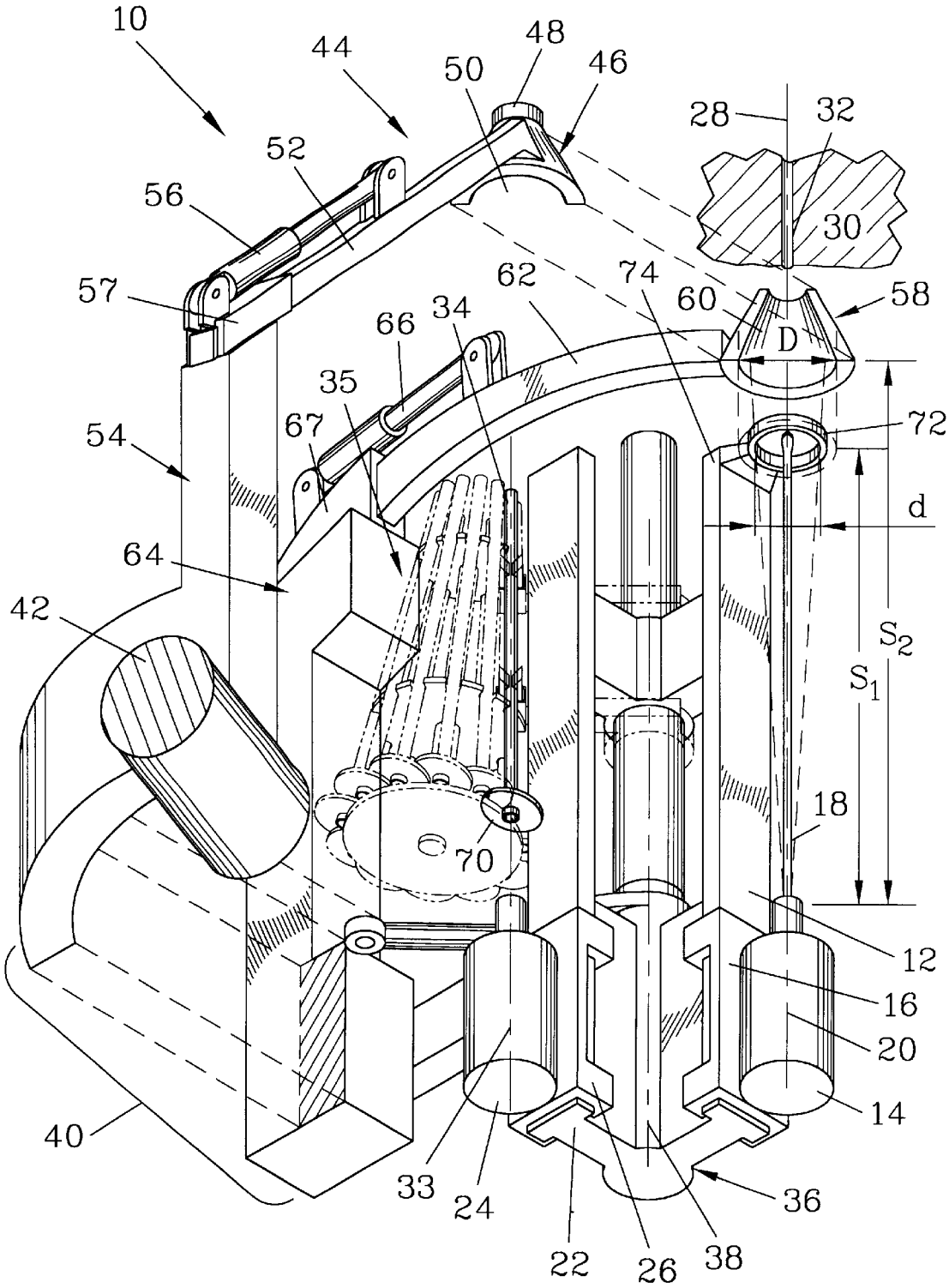
FIG. 1 is a partially exploded isometric view of a rock bolter of one embodiment of the present invention. The rock bolter has a turret on which are mounted dual feed tracks for positioning a rock drill and a rock bolter., and has a stinger/centralizer having a centralizer passage which is symmetrically disposed about a work axis. The rock bolter is shown in a drilling position, where the drill is aligned with the work axis of the stinger/centralizer.
Figure 2:
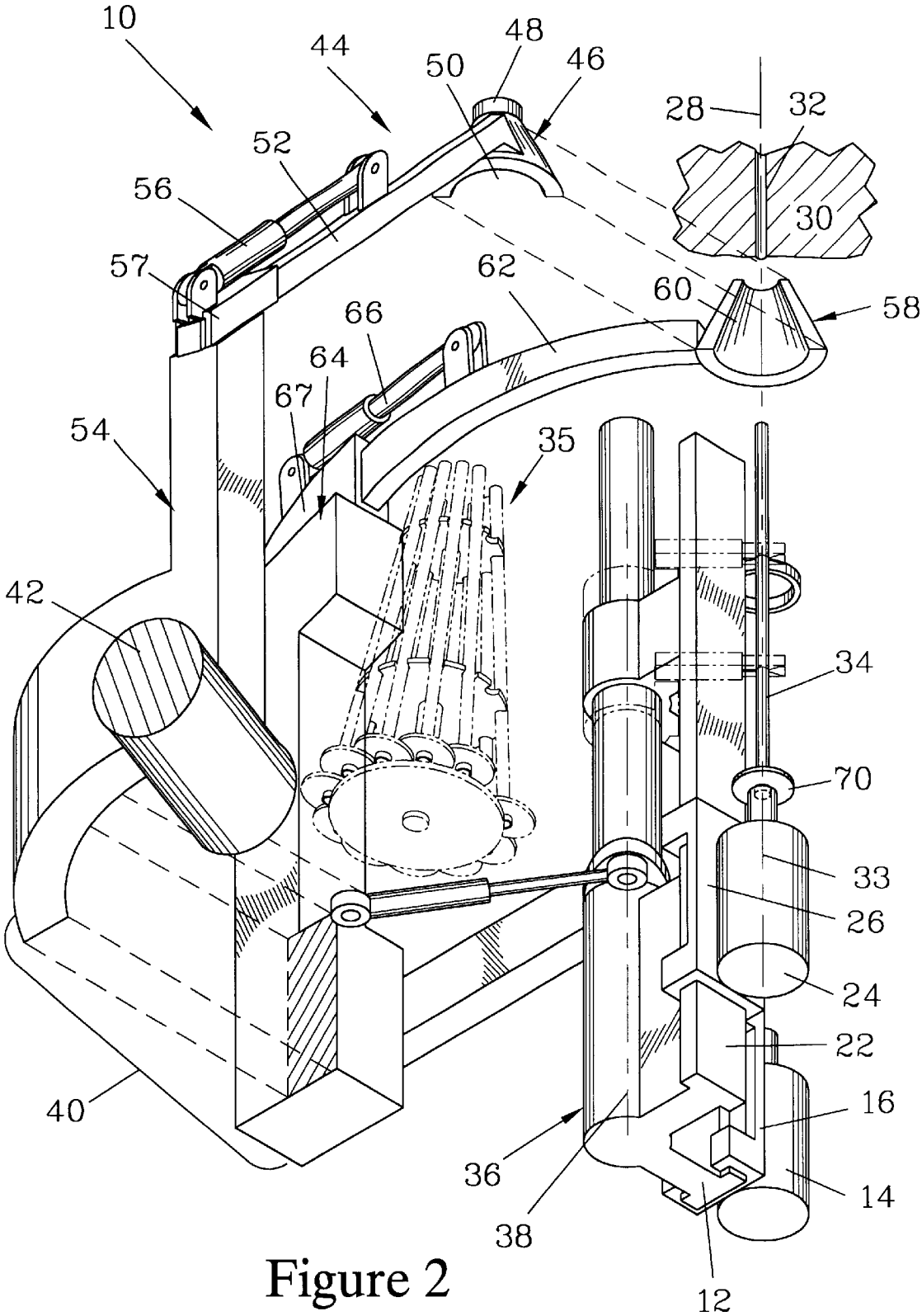
FIG. 2 illustrates the rock bolter shown in FIG. 1 in a bolt setting position where the bolt driver is aligned with the work axis.

FIGS. 1 and 2 are partially exploded isometric views of one embodiment of a rock bolter 10 of the present invention. Both views illustrate a drill feed track 12, along which a drill 14 mounted on a drill carriage 16 can be slidably advanced. The drill 14 is fitted with a drill steel 18 (shown in FIG. 1) which is substantially aligned with a drill axis 20. Also shown in both views is a bolt driver feed track 22, along which a bolt driver 24 mounted on a bolt driver carriage 26 can be slidably advanced. FIG. 1 illustrates the rock bolter 10 with the drill feed track 12 in a work position where the drill steel 18 and drill axis 20 are aligned with a work axis 28 along which the drill steel 18 is advanced into a rock surface 30 to drill a bolt hole 32. FIG. 2 illustrates the rock bolter 10 in its alternate position where the bolt driver feed track 22 is in the work position, where a bolt driver axis 33 of the bolt driver 24 is aligned with the work axis 28. When so positioned, the bolt driver 24 can engage a bolt 34 supplied from a bolt magazine 35 (shown in phantom), which can then be advanced into the bolt hole 32.

A turret 36 having a turret axis 38 is attached to both the drill feed track 12 and the bolt driver feed track 22. The attachment is such that the turret axis 38 is parallel to and spaced apart from the work axis 28. the drill axis 20, and the bolt driver axis 33. The turret 36 in turn is attached to a base 40 so as to pivot with respect to the base 40 about the turret axis 38 to selectively bring the drill feed track 12 and the bolt driver feed track 22 into the work position. The base 40 is in turn attached to a boom 42, which is employed to position the rock bolter 10 relative to the rock surface 30.

To stabilize the rock bolter 10 once it is positioned with respect to the rock surface 30, a stinger/centralizer 44 is provided. The stinger/centralizer 44, in addition to stabilizing the rock bolter 10, also serves to assure that the bolt hole 32 is drilled true to the rock surface 30 and that the bolt 34 can be readily directed into the bolt hole 32.

The stinger/centralizer 44 has a first head element 46 having a rock engaging surface 48 thereon and a first head cavity 50 therein. The first head element 46 is attached to a first head arm 52 which in turn slidably engages a first head arm mount 54 which is affixed to the base 40. A first linear actuator 56 is connected to the first head arm mount 54 and to the first head arm 52 and serves as a means for advancing and retracting the first head arm 52. The first head arm mount 54 is provided with a first guide sleeve 57 in which the first head arm 52 is slidably engaged. The interior surfaces of the first guide sleeve 57 serve as spaced-apart directing elements, while the exterior surfaces of the first head arm 52 serve as spaced-apart guide surfaces which engage the interior surfaces of the first guide sleeve 57. In combination, these surfaces provide means for guiding the first head arm 52 along a. prescribed path. Since the first head arm 52 and the first guide sleeve 57 of this embodiment are straight and engage on all sides, the first head element 46 traverses a linear path as it is advanced and retracted and the first head arm 52 traverses a path that is parallel to a first arm sweep plane.

A second head element 58 has a second head cavity 60 therein. The second head element 58 is attached to a second head arm 62 which slidably engages second head arm mount 64 which in turn is mounted to the base 40. A second linear actuator 66 is connected to the second head arm mount 64 and to the second head arm 62, and serves as a means for advancing and retracting the second head arm 62. The second head arm mount 64 is provided with a second guide sleeve 67 in which the second head arm 62 is slidably engaged. The interior surfaces of the second guide sleeve 67 serve as spaced-apart directing elements, which engage the exterior surfaces of the second head arm 62 that serve as spaced-apart guide surfaces. In combination, these surfaces provide means for guiding the second head arm 62 along a prescribed path. Since the second head arm 62 and the second guide sleeve 67 of this embodiment have one pair of curved surfaces and one pair of planar surfaces, the second head element 58 traverses a curved path that remains parallel to a second arm sweep plane as it is advanced toward the rock surface 30 and toward a position for engagement with the first head element 46. Similarly, the second head element 58 traverses a curved path as it moves away from the rock surface 30 and separates from the position for engagement with the first head element 46. The motion of the first and second head elements (46 and 58) allows the head elements (46 and 58) to separate such that the bolt driver 24 can advance the bolt 34 and an associated bolt plate 70 until the bolt plate 70 engages the rock surface 30.

In the rock bolter 10, means for engaging the first head element 46 with the second head element 58 so as to assure that the head elements (46 and 58) mate to produce a combined head cavity can be provided by configuring the first linear actuator 56, the first guide sleeve 57, second linear actuator 66, and the second guide sleeve 67 such that, when at the limits of their extensions, the first head element 46 and the second head element 58 are positioned with respect to each other so as to register the first head cavity 50 with the second head cavity 60.

The embodiment illustrated in FIGS. 1 and 2 also is provided with a drill steel retaining ring 72 which, in this embodiment, is mounted to the drill feed track 12 and positioned thereon so as to be axially aligned with the drill axis 20. The drill steel retaining ring 72 has an opening of diameter d, of sufficient size to accommodate a portion of the drill 14 passing therethrough, and is positioned sufficiently near a proximal end region 74 (the end region in closest proximity to the stinger/centralizer 44) of the drill feed track 12 so as to assure that the drill 14 can be advanced far enough to drill the bolt hole 32 with sufficient depth to fully set the rock bolt 34 therein. The diameter d of the drill steel retaining ring 72 is also maintained sufficiently small as to restrict flexing of the drill steel 18 so that its unsupported portion extending beyond the drill steel retaining ring 72 cannot deflect from the drill axis 20 by more than ½ of the maximum diameter D of the passage formed by the combination of the first and second head cavities (50 and 60). The latter requirement assures that the drill steel 18 will be directed into the passage formed by the first and second head elements (46 and 58) of the stinger/centralizer 44 when the drill 14 is advanced along the drill feed track 12 to bore the bolt hole 32. To assure that the drill steel 18 is not deflected from the drill axis 20 beyond the maximum diameter D, it is preferred that the ratio of the diameter d to a separation $S_1$ between the drill 14 and the drill steel retaining ring 72 be less than the ratio of the diameter D to a separation $S_2$ between the drill 14 and the first and second head cavities (50 and 60). Since the drill steel retaining ring 72 is closely positioned to the stinger/centralizer 44, it is felt that any curvature of the drill steel 18 (which would cause it to sweep out a flared cone rather than a straight cone) would insignificantly change their geometric relationship. When the drill steel 18 has an enlarged head which is larger than the shank of the drill steel 18, the relative difference in size of the head and the shank may further restrict the maximum size of the drill steel retaining ring 72. To reduce the possibility of interference with surrounding surfaces when the turret 36 is pivoted to position the bolt driver feed track 22 in the work position, it is preferred for the drill steel retaining ring 72 to be sized just sufficient to accommodate passage of the necessary portion of the drill 14.

Figure 3:
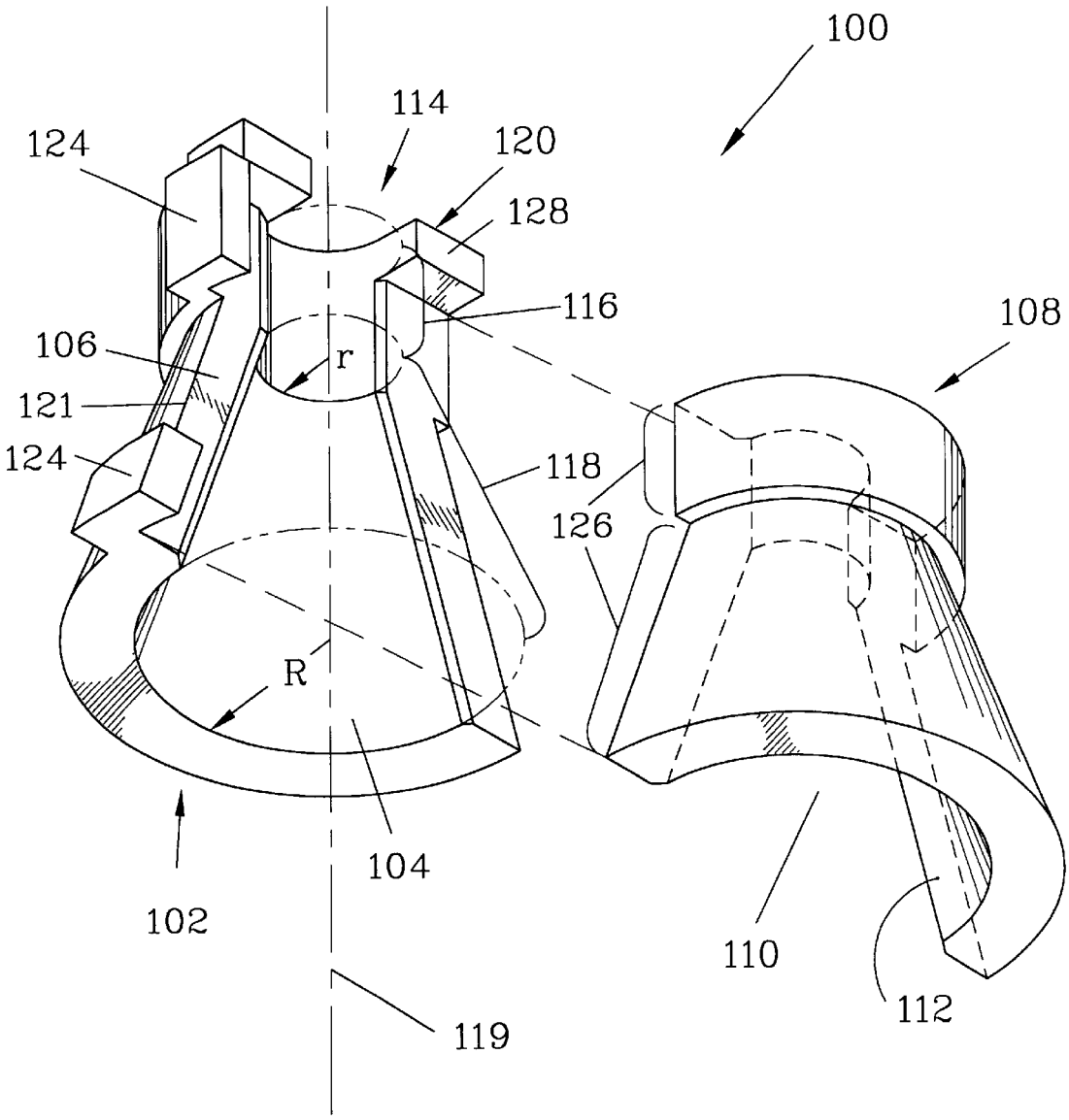
FIG. 3 is an isometric view showing a preferred embodiment of a head assembly which can be employed in a stinger/centralizer such as that shown in FIGS. I and 2. The head assembly has a first head element and a second head element which mate to form a head assembly having a combined head cavity with a conical guide portion and a cylindrical centralizer passage. The first head element is provided with tabs and a head lip for guiding the second head element into alignment therewith.

For rock bolters such as the rock bolter 10 shown in FIGS. 1 and 2, the first head arm 52 can be extended before the second head arm 62 is extended. FIG. 3 illustrates a preferred embodiment of a head assembly 100 which can be employed in place of the first and second heads (46 and 58) shown in FIGS. 1 and 2 when such a sequence of action is employed. The head assembly 100 has a first head element 102, having a first head cavity 104 and a first mating surface 106, which joins a second head element 108, having a second head cavity I 10 and a second mating surface 112. In this embodiment, the first mating surface 106 and the second mating surface 112 are substantially planar.

When the first and second head mating surfaces (106 and 112) are joined, the resulting head assembly 100 has a head assembly passage 114 having a first passage section 116, which is substantially cylindrical in cross section having a radius r and forming a cylindrical centralizer passage, and a second passage section 118, which is frusto-conical in form having a minimum radius r and increasing to a maximum radius R. forming a conical guide for directing a drill steel and a bolt into the first passage section 116. The head assembly passage 114 defines a central work axis 119. Preferably, the first head cavity 104 and the second head cavity 110 have chamfered or rounded edges to avoid any abrupt changes in the head assembly 100 resulting from slight misalignment of the first head cavity 104 and the second head cavity 110 that could cause interference with a drill steel, a bolt, or a resin cartridge.

The first head element 102 is designed to make engaging contact with a rock surface which is to be drilled and thereafter into which a bolt is to be driven. To assure engaging contact with the rock surface, a head pad 120 is provided on the first head element 102 and forms a rock engaging surface. Preferably, the head pad 120 is formed of a somewhat compliant material such as urethane.

The registry of the head elements (102 and 108) with respect to the work axis 119 is crucial to assure that the head assembly passage 114 is properly formed. Tabs 124 attached to the first head element 102 serve as stabilizing protrusions which extend beyond the first mating surface 106. When the second head element 108 is brought into contact with the first head element 102 to form the head assembly passage 114, the tabs 124 contact side edges 126 of the second head element 108 and limit motion of the second head element 108 in a direction parallel to the rock surface. The registry of the head elements (102 and 108) with respect to each other along the work axis 119 is not as critical, and a small degree of misalignment does not interfere with the function of the head assembly 100. A misalignment on the order of 10–15% of the axial length of the head cavities (104 and 110) has been found to be feasible. To obtain registry of the 110 head elements (102 and 108) along the work axis 119, the head pad 120 is preferably provided with a head lip 128 which extends beyond the first mating surface 106 to limit motion of the second head element 108 in the direction of the rock surface, serving as an additional stabilizing protrusion and receptor. In combination, the tabs 124 and the head lip 128 assure registry of the second head element 108 with the first head element 102 when the second head element 108 is fully advanced and in contact with the tabs 124 and the head lip 128. When the first and second head elements (102 and 108) are so registered, the first head cavity 104 is aligned with the second head cavity 110, assuring proper formation of the head assembly passage 114.

Figure 4:
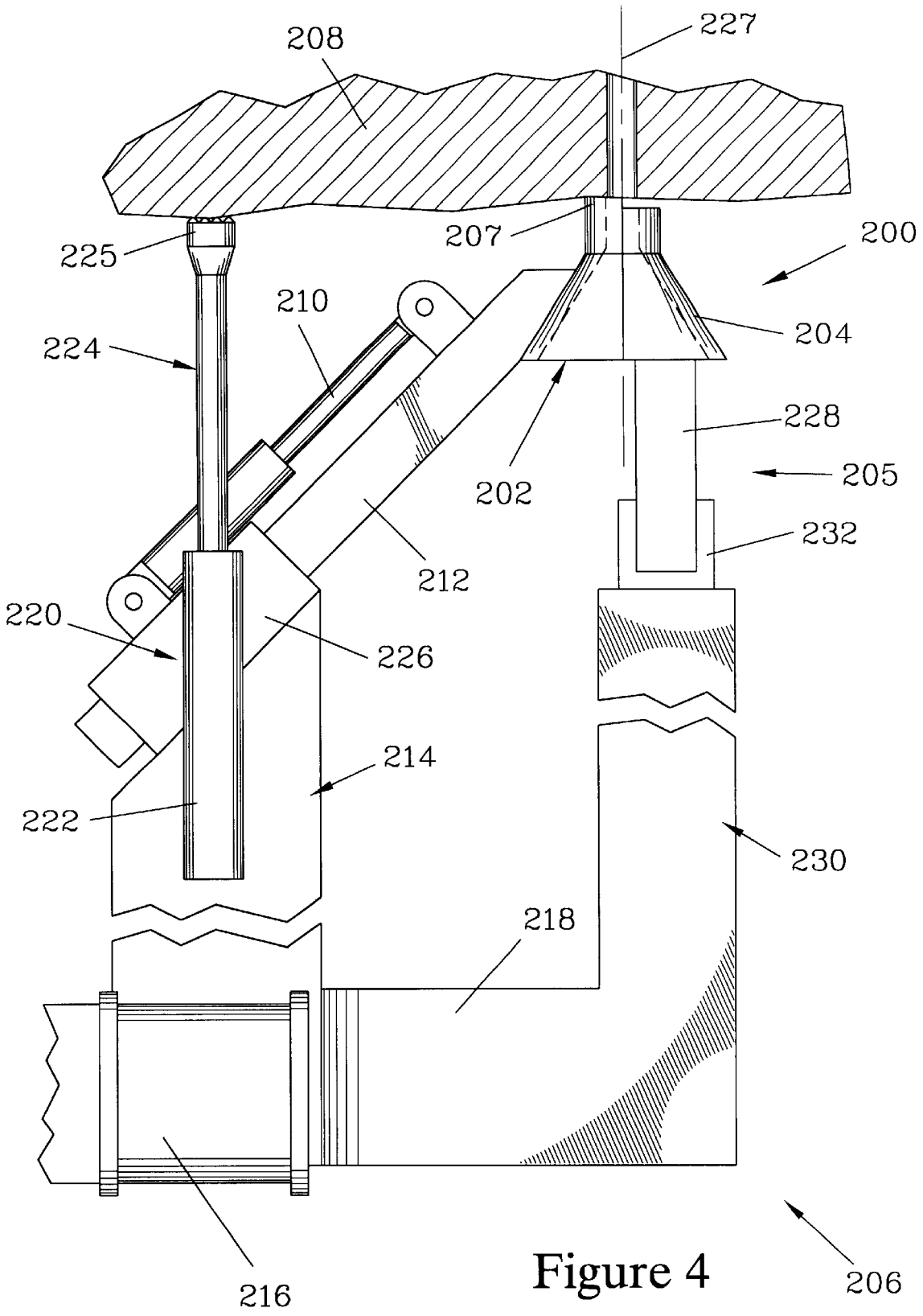
FIG. 4 is a partial side view of rock bolter having a supplementary stinger. The supplementary stinger is engaged with the rock surface after the primary stinger had been brought into contact with the rock surface, and serves to stabilize the rock bolter when the first head element is withdrawn from the rock surface. This embodiment employs a second head arm which is curved and forms an arc.
Figure 5:
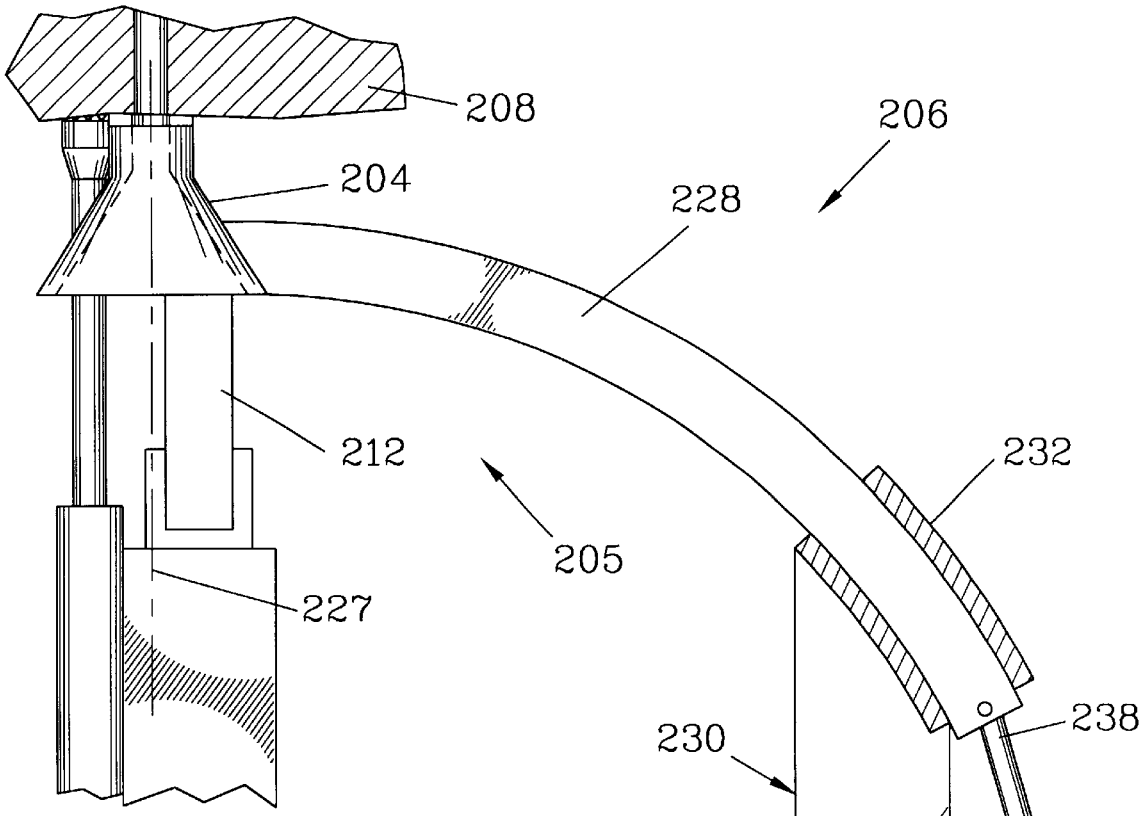
FIG. 5 is a side view of the second head arm shown in FIG. 4.

FIGS. 4 and 5 illustrate a head assembly 200, having a first head element 202 and a second head element 204 which form part of a stinger/centralizer 205 of a rock bolter 206, which is only partially shown. The head assembly 200 is constructed such that the first head element 202 has a rock engaging surface 207 which is designed to be forcibly engaged with a rock surface 208 and serves as a stinger to stabilize feed tracks (not shown) with respect to the rock surface 208 during the drilling and bolt setting operations. A first linear actuator 210 is attached to a first head arm 212, to which the first head element 202 is attached, and to a first head arm mount 214. The linear actuator 210 serves to advance the first head element 202 to an extended position where the rock engaging surface 207 can be forcibly engaged with the rock surface 208. The gripping force of the engagement is provided by a boom 216 which transmits the force to the first head element 202 via a base 218, the first head arm mount 214, and the first head arm 212. It is preferred that the boom 216 be in close proximity to the first head mount 214 so as to minimize the moment exerted on the boom 216 by the normal force exerted by the rock surface 208 on the first head element 202.

In this embodiment, a supplementary stinger 220 is provided and is mounted on the first head arm mount 214. The supplementary stinger 220 has a stinger body 222 and an extendable member 224 having a rock engaging end 225 for forcibly engaging the rock surface 208. Means for extending the extendable member 224 with respect to the stinger body 222 are provided. Such means can be readily provided by forming the supplementary stinger 220 from a linear actuator, the body of the liner actuator serving as the stinger body 222 and the piston of the linear actuator serving as the extendable member 224, to which the rock engaging end 225 is attached. Alternatively, the piston can be attached with respect to the base to serve as the stinger body 222, in which case the rock engaging end 225 is mounted to the body of the linear actuator which serves as the extendable member 224.

When the means for extending the extendable member 224 with respect to the stinger body 222 are activated, the rock engaging end 225 of the supplementary stinger is brought into forcible engagement with the rock surface 208 at a location spaced apart from the site of engagement by the rock engaging surface 207 of the first head element 202. The supplementary stinger 220 assures that the bolt driving feed track (not shown) continues to be stabilized when the first head element 202 is withdrawn from the rock surface 208, which must be done before the bolt setting operation can be completed. This continued stabilization eliminates any bending moment on the bolt being driven which can result from retraction of the first head element 202 from the rock surface 208. This feature of the invention has utility not only for dual feed track rock bolters, but also for single feed track rock bolters which employ a stinger/centralizer, such as the preferred embodiments described in U.S. Pat. No. 5,556, 235.

In the embodiment illustrated in FIGS. 4 and 5, the first head arm 212 is straight and slidably engages a straight bracket 226 attached to the first head arm mount 214. The straight bracket 226 is configured to provide interior directing elements which engage exterior guide surfaces on the first head arm 212 to provide motion of the first head element 202 which is substantially linear as the first head element 202 is extended and retracted. This straight configuration results in smaller bending moments on the first head arm 212 due to forcible engagement of the first head element 202 with the rock surface 208 than would result from other configurations of the first head arm 212, such as using a curved arm. Preferably, the inclination of the first head arm 212 with respect to a work axis 227 is maintained in the angular region of between about 30 and 60 degrees to provide adequate gripping force between the rock engaging surface 207 and the rock surface 208 and reasonably small bending moments, while providing sufficient displacement of the first head element 202 from the work axis 227 to allow a drill and a bolt driver (not shown) to pass thereby without interference when the first head element 202 is retracted. More preferably, the inclination of the first head arm 212 is about 45 degrees, which is felt to provide a good balance between providing gripping force, reducing bending moments, and displacing the first head element 202. The preferred angular relationship can be readily maintained for the first head arm 212, since it is at all times substantially spaced apart from both the feed tracks of the dual feed track rock bolter. However, for dual feed track rock bolters, a straight second arm such as employed in the stinger/centralizers described in the '235 patent cannot be readily employed without significantly increasing the overall length of the rock bolter.

Accordingly, in the embodiment illustrated in FIGS. 4 and 5, the second head element 204 is attached to a second head arm 228 which, rather than being a substantially straight member, is curved and forms an arc, as shown in FIG. 5. The second head arm 228 slidably engages a second head arm mount 230 which is affixed with respect to the base 218. The second head arm mount 230 has an arcuate bracket 232 in which the second head arm 228 slides. The arcuate bracket 232 is provided with interior directing elements which engage exterior guide surfaces on the second head arm 228, guiding the second head element 204 to move along an arcuate path. The arc-shaped second head arm 228 provides clearance for elements of the rock bolter 206 which reside therebeneath without an increased separation of the head elements (202 and 204) from the feed tracks, thus allowing the rock bolter 206 to be constructed more compactly.

To provide means for advancing and withdrawing the second head element 204 to and from an extended position where it is positioned to engage the first head element 202, a second head linear actuator 234 is provided. The second head linear actuator 234 has a second head actuator base end 236, which is connected to the second head arm mount 230, and has a second head actuator work end 238, which is connected to the second head arm 228. In this embodiment, the second head linear actuator 234 is a hydraulic cylinder.

Since the second head arm 228 does not support a head element which forcibly engages the rock surface 208, the loads on the curved structure are relatively small and there are no large bending moments such as are associated with the first head arm 212. In cases where the first head element 202 is withdrawn from the rock surface 208 before withdrawing the second head element 204, the supplementary stinger 220 also serves to stabilize the second head element 204 as the first head element 202 is withdrawn, preventing forcible engagement of the second head element 204 with the rock surface 208 and avoiding large bending moments on the second head arm 228 as the first head element 202 is withdrawn from the rock surface 208.

Figure 6:
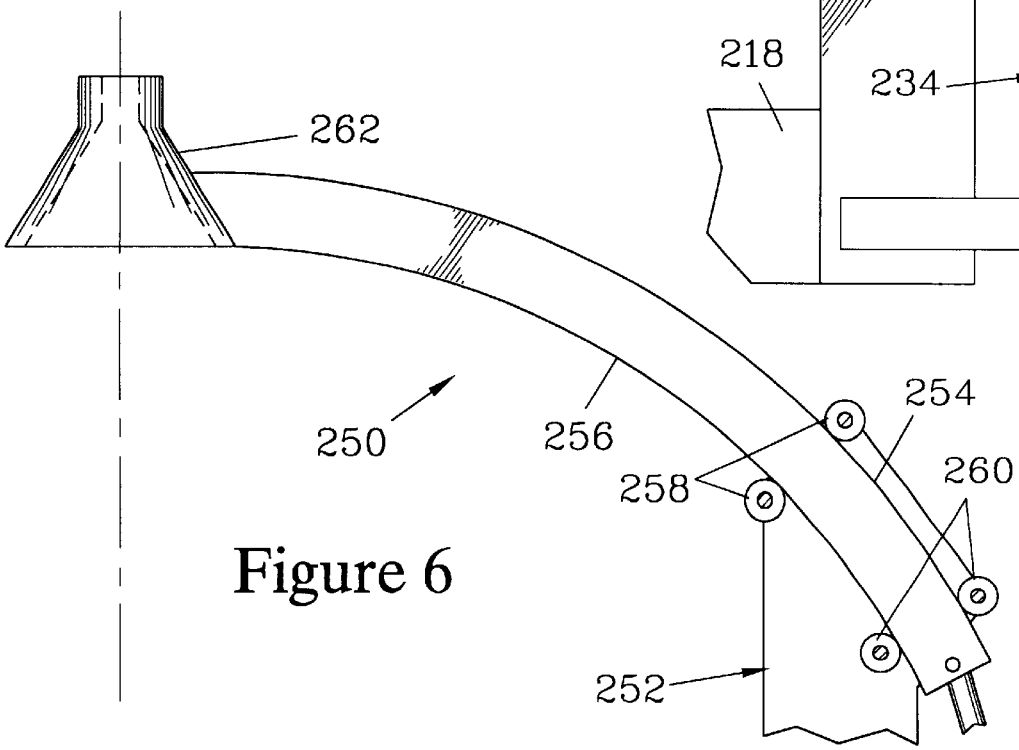
FIG. 6 illustrates another embodiment of the present invention which has an alternative arc-shaped second head arm. This embodiment employs rollers as the directing elements, which engage guide surfaces on the second head arm to provide an arcuate motion similar to the motion obtained in the embodiment illustrated in FIGS. 4 and 5. The rollers reduce the friction as the second head arm is advanced and retracted.

FIG. 6 illustrates an alternative second head arm 250, which allows reduced friction between the second head arm 250 and a second head arm mount 252, as well as allowing redesign by changing the configuration of the second head arm 250. In this embodiment, the second head arm 250 is formed with a first guide surface 254 and a second guide surface 256. The second head arm mount 252 is provided with a first pair of rollers 258 and a second pair of rollers 260, which serve as directing elements. One of each pair of rollers (258, 260) is positioned to directably engage the first guide surface 254, while the other of each pair of rollers (258, 260) is positioned to directably engage the second guide surface 256. The first guide surface 254 and the second guide surface 256 are maintained at a constant spacing to allow the rollers (258 and 260) to control the motion of the second head arm 250. In the embodiment illustrated, the first guide surface 254 and the second guide surface 256 are configured to provide motion of the second head arm 250 such that a second head element 262 traverses an arcuate path.

Since the contour of the first guide surface 254 and the second guide surface 256 determines the motion of the second head arm 250, different configurations of the second head arm 250 can be installed to provide the particular motion desired. However, if the second head arm 250 is configured to provide motion which is not a simple arc, the mounting of the pairs of rollers (258 and 260) to the second head arm mount 252 must accommodate some degree of adjustment to prevent binding.

While there are many benefits obtained with the use of arcuately-curved arms when the rock surface is relatively flat, such a configuration of the second head arm is not well suited to use where the rock surface is highly irregular.

When such a curved arm is used, the second head element frequently has a large component of its motion parallel to the rock surface when the second head element is near its extended position. If the rock surface is highly irregular, it may interfere with extension and retraction of the second head element. While interference during extension can frequently be avoided by extending the second head arm prior to using the boom to position the head elements in close proximity to the rock surface to force the first head element against the rock surface, retraction occurs when the second head element is positioned close to the rock surface to guide the bolt thereinto, and any repositioning using the boom might result in bending the bolt. Thus, in situations where the rock surface is highly irregular, it is preferred to employ a second head arm which provides the second head element with a substantial component of motion normal to the rock surface when the second head element is in close proximity the rock surface near its extended position to prevent interference.

Figures 7A, 7B:
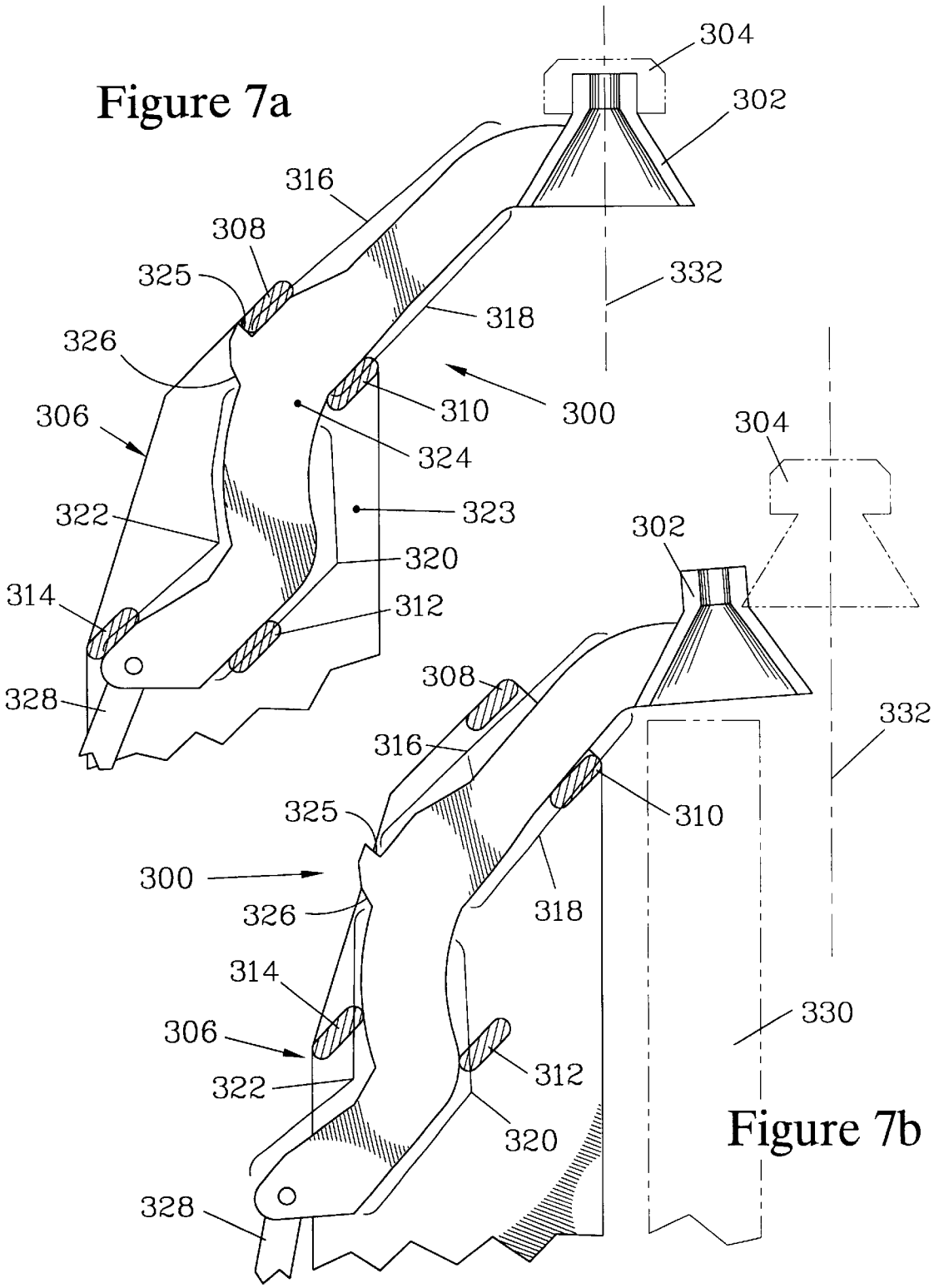
FIGS. 7*a* through 7*c* illustrate an alternative second head arm which provides complex curvilinear motion of a second head element along a path which has both arcuate and linear segments. The second head arm of this embodiment has specially contoured edge segments which serve as guide surfaces. Cams on the second head arm mount act as directing elements which engage the guide surfaces to control the motion of the second head arm.
Figure 7C:
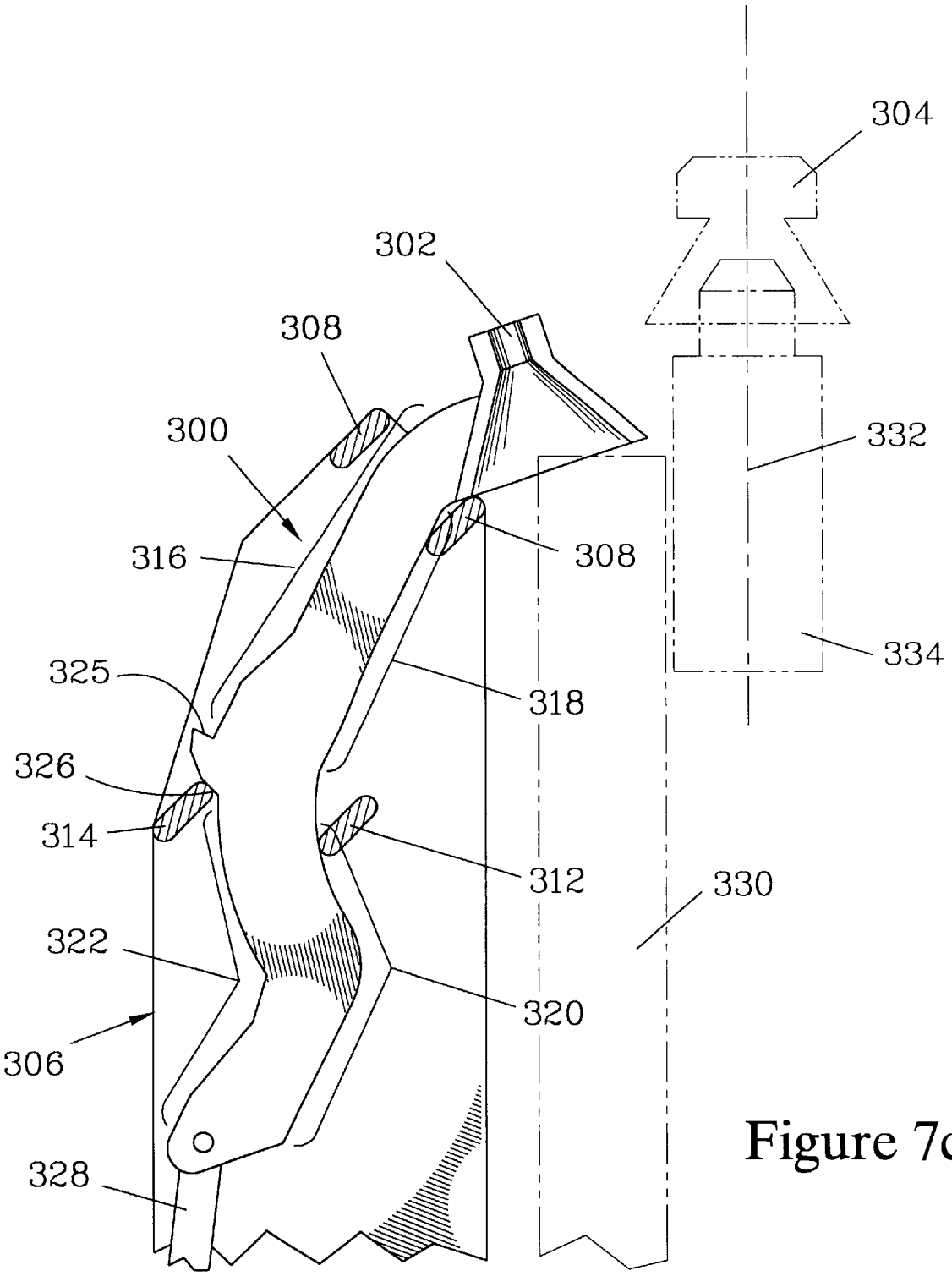

FIGS. 7*a* through 7*c* show three positions of an alternative second head arm 300 which provides a curvilinear motion for a second head element 302, where the path of the curvilinear motion is composed of both curved and linear segments. The second head arm 300 is configured to move the second head element 302 along a linear path segment when the second head element is near an extended position where it is positioned to engage a first head element 304 (shown in phantom in an extended position). Such linear motion allows the second head element 302 to have a substantial portion of its angular motion be either toward or away from a rock surface when in close proximity to the rock surface.

The second head arm 300 again movably engages a second head arm mount 306. In this embodiment, the means for guiding the second head arm 300 include first, second, third, and fourth cams (308, 310, 312, and 314) mounted on the second head arm mount 306, which serve as directing elements. The first, second, third, and fourth cams (308, 310, 312, and 314) respectively intermittently engage first, second, third, and fourth guide surfaces (316, 318, 320, and 322) provided on the second head arm 300. The second head arm mount 306 also has a pair of spaced apart sidewalls 323 (one of which is shown in FIG. 7*a*) which constrain second arm sidewalls 324 (again, only one is shown) on the second head arm 300 to maintain the motion of the second head arm 300 substantially parallel to a second arm sweep plane. The second head arm 300 is also provided with an arm-extended stop surface 325 and an arm-retracted stop surface 326. Means to advance and retract the second head arm 300 are provided by a second arm linear actuator 328 (only partially shown) which is connected between the second head arm 300 and the second head arm mount 306.

FIG. 7*a* illustrates the second head arm 300 when it is fully extended, where the second head element 302 is positioned so as to mate with the first head element 304 when a first head arm (not shown) carrying the first head element 304 is extended. When the second head arm 300 is fully extended, the arm-extended stop surface 325 engages the first cam 308. As the second arm linear actuator 328 is retracted, the first, second, third, and fourth cams (308, 310, 312, and 314) act as spaced apart directing elements which slidably engage linear portions of the spaced apart first, second, third, and fourth guide surfaces (316, 318, 320, and 322) of the second head arm 300. The respective engagement of the first, second, third, and fourth cams (308, 310, 312, and 314) with the first, second, third, and fourth guide surfaces (316, 318, 320, and 322) constrains the second head arm 300 to move in a linear manner. This causes the second head element 302 to initially move in a linear manner away from the rock surface. Similarly, when the second head arm 300 is extended to move the second head element 302 into its extended position for engagement with the first head element 304, the second head element 302 approaches its extended position in a linear manner.

However, as the second arm linear actuator 328 is further retracted, as shown in FIG. 7*b*, the first guide surface is configured such that the first cam 308, which provides the first directing element, loses contact with the first guide surface 316, while the second, third, and fourth cams (310, 312, and 314) respectively engage the second, third, and fourth guide surfaces (318, 320, and 322) at portions beyond their initial linear portions. Thus, the second head arm 300 is no longer constrained to move in a linear manner. The engagement of the second, third, and fourth cams (310, 312, and 314) with the second, third, and fourth guide surfaces (318, 320, and 322) directs rotation of the second head arm 300 such that it rotates in a plane parallel to the second arm sweep plane. This rotation allows the second head element 302 to be raised to clear the end of a turret 330 (shown in phantom) over which the second head arm 300 traverses.

When the second arm linear actuator 328 is fully retracted, as shown in FIG. 7*c*, the fourth cam 314 engages the arm-retracted stop surface 326 on the second head arm 300. In this position, the second head element 302 is sufficiently spaced apart from a work axis 332 as to allow a bolt driver 334 (shown in phantom) to be advanced along the work axis 332 without interference with the second head element 302.

Figure 8A:
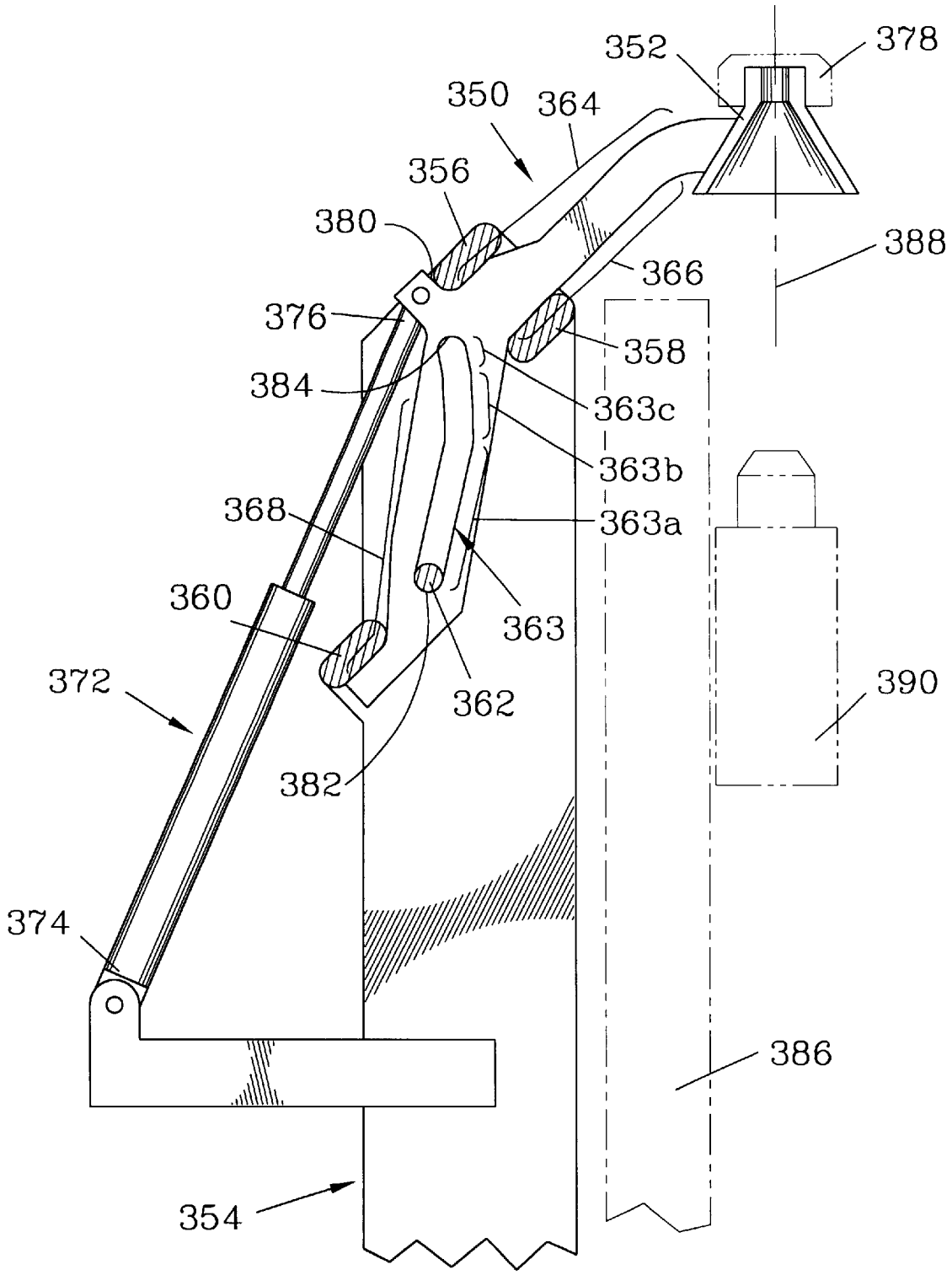
FIGS. 8*a* through 8*c* illustrate another embodiment of second head arm, which employs a guide slot and a slot follower which serve respectively as guide surfaces and a directing element, in combination with cams which also serve as directing elements which selectively engage guide surfaces which form segments of the surface of the second head arm. The combined use of a slot and a follower with cams and guiding surfaces provides greater flexibility in the motion obtainable without requiring the machining of very intricate and complex guide surfaces.
Figure 8B:
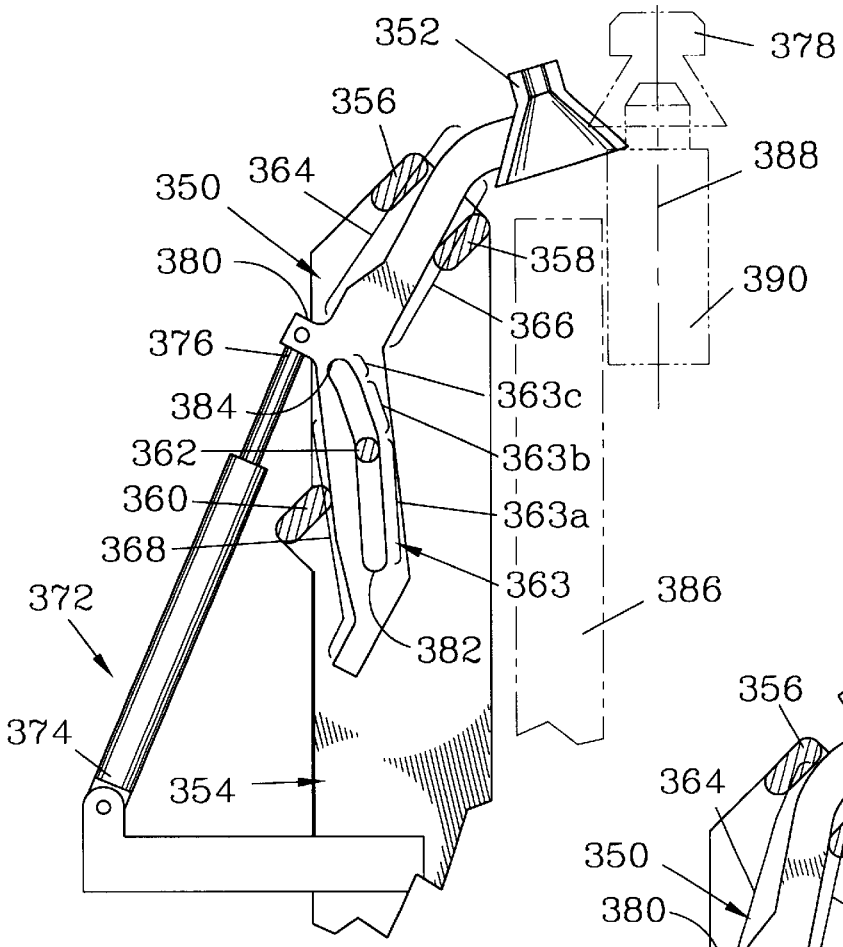
Figure 8C:
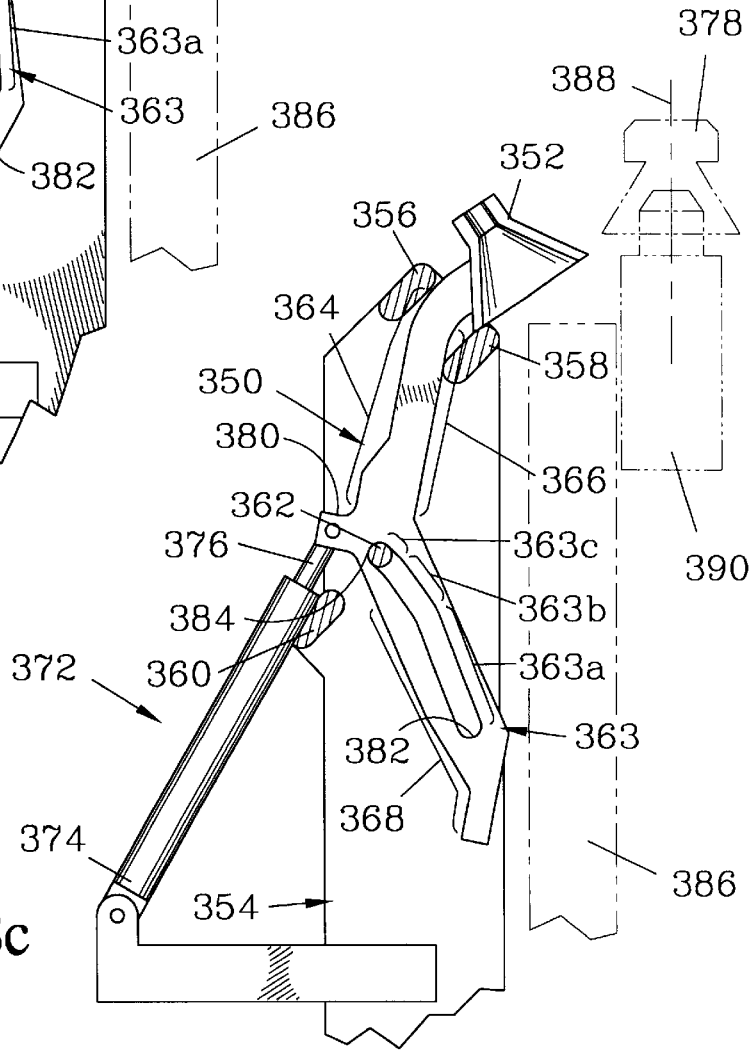

FIGS. 8*a* through 8*c* illustrate an alternative second head arm 350 which can be employed to provide motion of a second head element 352 along a path having multiple segments with sharp changes in the motion of the second head element 352 as the second head element 352 moves from one segment of the path to the next. Such paths are herein described as inflected paths. For the second head arm 350 illustrated, the motion of the second head element 352 when it is in close proximity to the rock surface has a substantial component of motion normal to the rock surface. To provide such a path for the second head arm 350, a second head arm mount 354 is employed which has first, second, and third cams (356, 358, and 360), which serve as spaced apart directing elements, and a slot follower 362, which is disposed in a guide slot 363 provided in the second head arm 350 and which also serves as a directing element. In this embodiment, the slot follower 362 is a rotatably mounted roller to reduce friction, and the wall of the roller which serves as a directing element engages the sidewalls of the slot 263 which serve as spaced apart guide surfaces. In addition to the guide slot 363 for engaging the slot follower 362, the second head arm 350 is provided with first, second, and third guide surfaces (364, 366, and 368) for engaging the first, second, and third cams (356, 358, and 360) to direct the motion of the second head arm 350.

The first, second, and third cams (356, 358, and 360) respectively and, in some cases, intermittently engage the first, second, and third guide surfaces (364, 366, and 368) provided on the second head arm 350, while the slot follower 362 at all times engages the guide slot 363 in the second head arm 350. The slot follower 362 and the cams (356, 358, and 360) direct the motion and orientation of the second head arm 350. The action of the second head arm 350 is largely determined by the configuration of the guide slot 363. The use of the guide slot 363 provides a means for guiding the second head arm 350 which is readily machined and which reduces requirements on the tolerances required for the exterior surfaces of the second head arm 350, thus allowing a greater range of motion for the second head arm 350 and allowing it to be constructed with a more optimal distribution of weight than is feasible with the second head arms (250, 300) discussed above.

To provide means for advancing and retracting the second head arm 350, a second head linear actuator 372 is provided. The second head linear actuator 372 has a second head actuator base end 374, which is connected to the second head arm mount 354, and has a second head actuator work end 376, which is connected to the second head arm 350. The second head linear actuator 372 resides in a plane which is parallel to a sweep plane for the second head arm 350 to assure planar motion of the second head arm 350.

When the second head linear actuator 372 is in an extended position, as shown in FIG. 8*a*, the second head element 352 is positioned to be by a first head element 378 (shown in phantom in an extended position). The extension of the second head element 352 is limited by engagement of the first cam 356 with an arm-extended stop surface 380 provided on the second head arm 350, and/or by engagement of the slot follower 362 with a first slot end 382 of the guide slot 363. When the second head arm 350 is fully extended, it is stabilized by the engagement of the slot follower 362 with the guide slot 363 and by the close constraint of the first and second guide surfaces (364 and 366) between the first and second cams (356 and 358). As the second head arm 350 is initially retracted, the respective engagement and/or constraint of the first, second, and third guide surfaces (364, 366, and 368) by the first, second, and third cams (356, 358, and 360) and the engagement of the slot follower 362 with a first slot segment 363*a* of the guide slot 363 directs the second head arm 350 along a path with a substantial component of motion away from the rock surface, while providing a slight rotation of the second head arm 350.

FIG. 8*b* illustrates the second head arm 350 when the second head linear actuator 372 is partially retracted and the separation between the rock surface and the second head element 352 has been increased. At this point, the second head arm 350 is guided by the respective engagement of the third cam 360 with the third guide surface 368 and by the guide slot 363 as it moves over the slot follower 362, as well as by the first and second guide surfaces (364 and 366) being more loosely constrained between the first and second cams (356 and 358). At the position shown in FIG. 8*b*, the motion of the second head arm 350 still provides only a slight rotation; however, the slot follower 362 is approaching a second slot segment 363*b*, which is configured to guide the motion of the second head arm 350 so as to provide a greater rotation of the second head arm 350 to maintain clearance with any underlying structure.

When the second head linear actuator 372 is fully retracted, as shown in FIG. 8*c*, the withdrawn position of the second head arm 350 is limited by the respective engagement of the first and second cams (356 and 358) with the first and second guide surfaces (364 and 366) and/or by the engagement of the slot follower 362 with a second slot end 384 of the guide slot 363. The guide slot 363 is preferably provided with a third slot segment 363*c*, which is configured to provide a further increased rotation of the second head arm 350 as it approaches its fully retracted position. In the fully retracted position, second head arm 350 is rotated so as to position and orient the second head element 352 above a turret 386 (shown in phantom) and sufficiently spaced apart from a work axis 388 as to allow a bolt driver 390 (also shown in phantom) to be advanced along the work axis 388 without interference with the second head element 352.

While second head arms which move the second head element along a path having multiple segments provide several benefits, the complex motion can make proper registry of the head elements difficult. To obtain proper registry, it is preferred to provide an interlocking engagement of the head elements. In order to obtain such a relationship in cases where the motion of the second head element is a complex curve, it is preferred for the second head arm to be extended prior to extending the first head arm, so that the motion of the first head arm can move the first head element toward the second head element along a linear path. Thus, when the second head arm is configured to provide complex motion along a path having multiple segments, this sequence allows the head elements to become engaged by a substantially linear motion.

Figure 9:
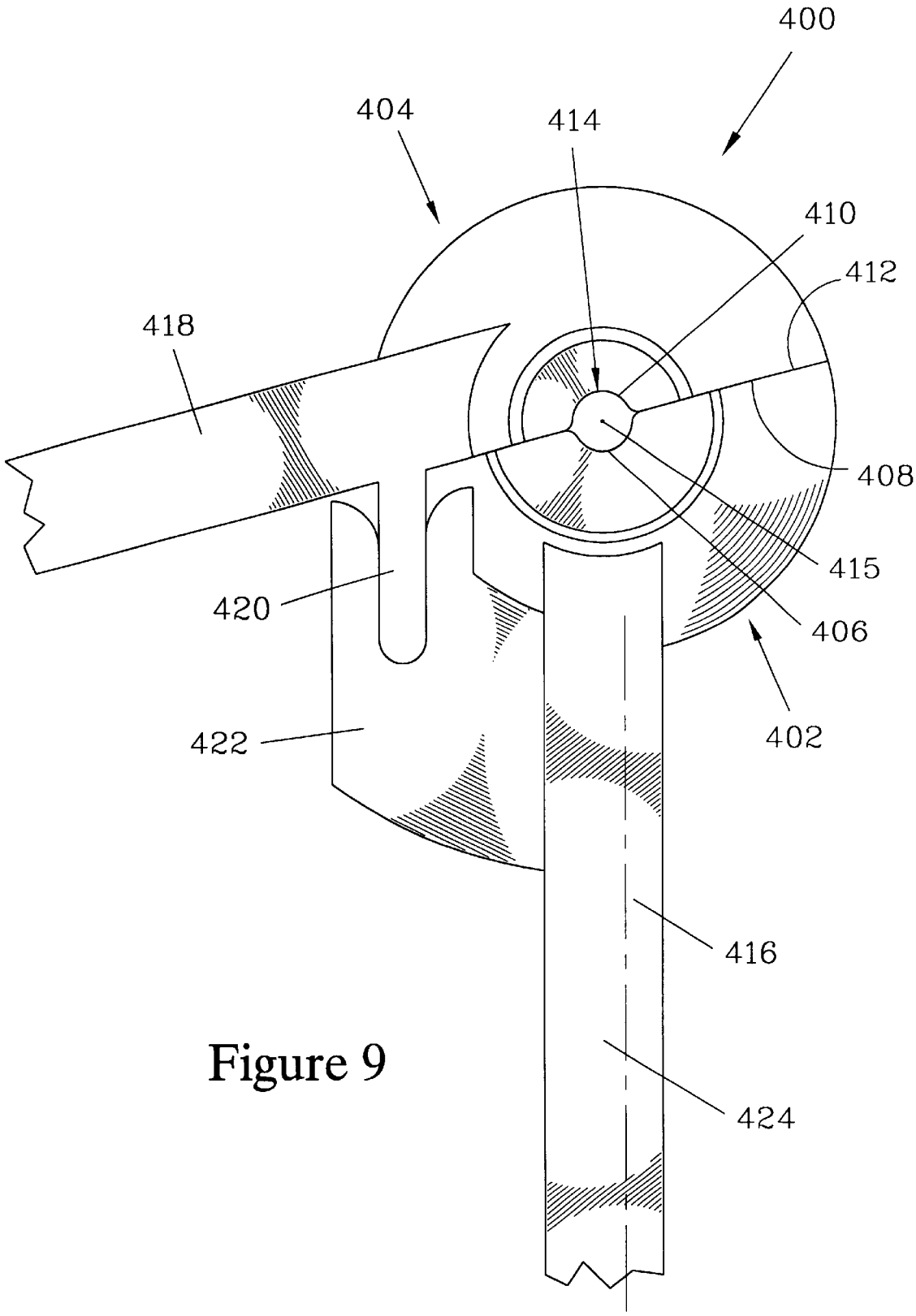
FIG. 9 is a top end view showing another embodiment for the head assembly, which is well suited to use with the second head arms shown in FIGS. 6–8 in applications where the second head arm is extended first. In this embodiment, the first head element and the second head element are provided with substantially planar mating surfaces which, when joined, lie in a plane which is substantially perpendicular to a sweep plane of the first head element, the sweep plane being defined as a plane in which the motion of the first head arm resides. A key having key guide surfaces and a keyway having keyway guide surfaces are arranged to align with the first head sweep plane.

FIG. 9 is a top view showing a head assembly 400 which provides an interlocking engagement between a first head element 402 and a second head element 404. The first head element 402 has a first head cavity 406 and a first mating surface 408, while the second head element 404 has a second head cavity 410 and a second mating surface 412. When the first and second mating surfaces (408 and 412) are joined, the resulting head assembly 400 has a head assembly passage 414 similar to the head assembly passage 114 discussed above with regard to the embodiment shown in FIG. 3, the head assembly passage 414 residing on a work axis 415. The first head element 402 is mounted to a first head arm 416, while the second head element 404 is mounted to a second head arm 418. The interlocking engagement of this embodiment is designed for use where the second head arm 418 is extended before the first head arm 416. For this head configuration and mode of operation, it is also preferred that the first mating surface 408 and the second mating surface 412 be substantially normal to the direction in which the first head element 402 approaches the second head element 404.

The head assembly 400 differs from the head assembly 100 in that proper registry of the first head element 402 and the second head element 404 is provided by a key 420 which is affixed with respect to the second head element 404. The key 420 serves as a stabilizing protrusion for the second head element 404. A keyway 422 which is affixed with respect to the first head element 402 provides receptor guiding surfaces for the first head element 402 which are configured to guidably engage the key 420. As noted above, the head assembly 400 is designed for rock bolters where the second head arm 418 is advanced into position prior to the first head arm 416. When the second head arm 418 is in its extended position, the key 420 is oriented such that it will be readily engaged by the keyway 422 of the first head element 402 as the first head arm 416 is extended.

When the motion of the first head element 402 is substantially linear as the first head arm 416 is extended, the path of the first head element 402 resides in a sweep plane 424 which is parallel to or contains the work axis 415. The key 420 and keyway 422 are configured to slidably engage each other parallel to the sweep plane 424. The key 420 and keyway 422 act in concert to guide the first head element 402 and the second head element 404 into alignment with each other while the first head element 402 is advanced toward engagement with the second head element 404.

The first head arm 416 is preferably configured such that, when fully extended, the first head element 402 is substantially aligned with the second head element 404 along the work axis 415. The key 420 and keyway 422 maintain the first head element 402 and the second head element 404 in alignment with each other while allowing the first head element 402 to move axially with respect to the second head element 404, thereby allowing adjustment of the head elements (402 and 404) with each other when the first head element 402 is forcibly engaged with the rock surface. It is further preferred that the mating edges of the head cavities (406 and 410) be chamfered edges to accommodate for any residual misalignment that may exist.

Preferably, the first head element 402 is also configured to be extended until stopped by interference with the second head element 404, thereby positively positioning the first head element 402. The forcible engagement caused by such interference assures firm engagement of the first and second head mating surfaces (408 and 412) and eliminates free play in the first and second head arms (416 and 418). This is particularly desirable when the first head arm 416 and the second head arm 418 are configured to provide a degree of looseness to provide improved reliability in the underground environment of a mine. When the first and second head elements (402 and 404) are retracted, the first head element 402 is retracted first in order to disengage the key 420 from the keyway 422 prior to retracting the second head element 404.

Figure 10:
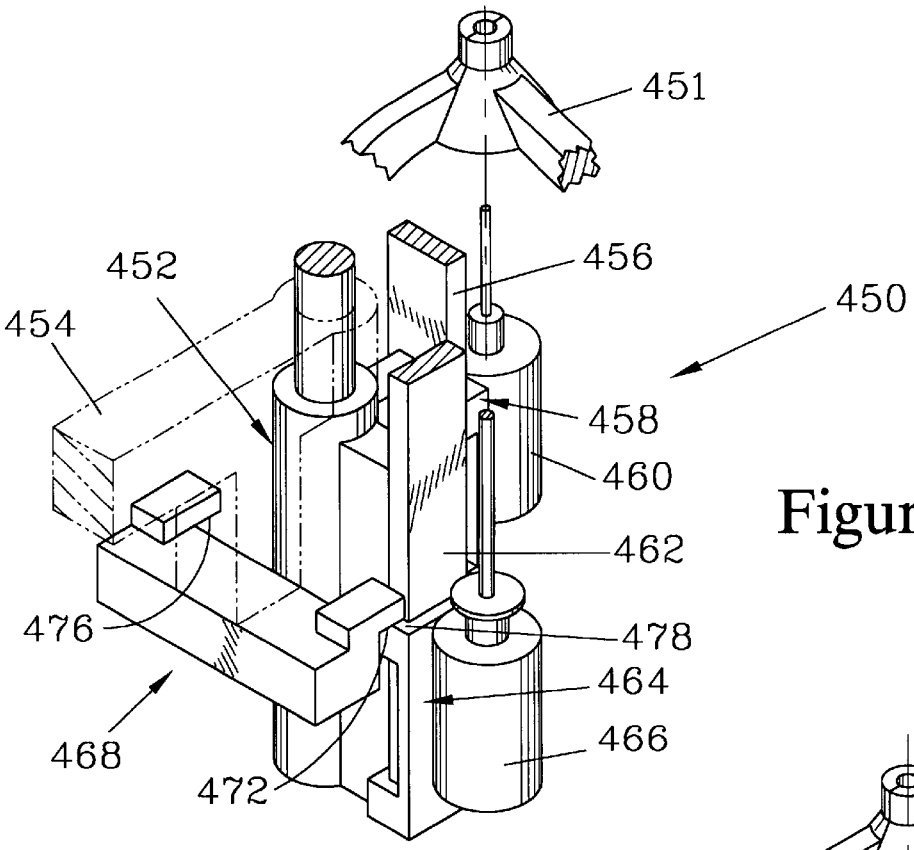
FIG. 10 is a partial view of a rock bolter which incorporates one embodiment of a carriage stop member of the present invention. The carriage stop member has utility for rock bolters which have dual feed tracks with separate rock drill and bolt driver carriages and which employ a common means for advancing and retracting the rock drill and the bolt driver. The carriage stop member disables the carriage on which an inactive tool that is not aligned with the work axis is carried.
Figure 11:
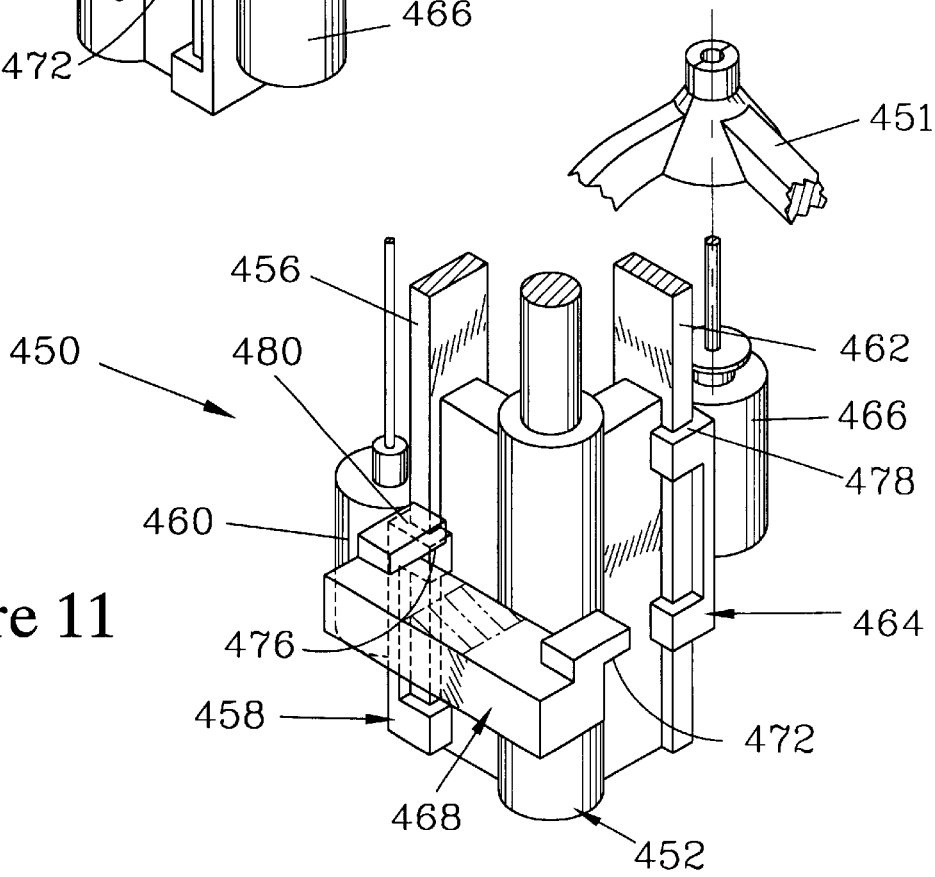
FIG. 11 shows the embodiment of FIG. 10 where the turret is positioned such that the carriage stop member blocks advancement of the drill.

FIGS. 10 and 11 illustrate selected structural elements of another embodiment of the present invention, which provides a carriage disabling mechanism for a dual feed track rock bolter. In this embodiment, a rock bolter 450 has a stinger/centralizer 451, and a turret 452 which is pivotally mounted with respect to a base 454. The turret 452 has a drill feed track 456, which is slidably engaged by a drill carriage 458 (best shown in FIG. 11) to which a drill 460 is mounted. The turret 452 also has a bolt driver feed track 462 mounted thereon, which is slidably engaged by a bolt driver carriage 464, on which a bolt driver 466 is mounted.

A carriage stop member 468 is provided, which in this embodiment is affixed to the base 454. If the rock bolter 450 is designed to allow translation as well as pivoting of the turret 452, the carriage stop member is mounted with respect to the base so as to translate with the turret 452. In all cases. the carriage stop member 468 has a bolt driver carriage disabling surface 472 (best shown in FIG. 11), as well as a drill carriage disabling surface 476 (best shown in FIG. 10). The carriage stop member 468 is mounted to the base 454 and positioned with respect to the turret 252 such that, when the drill feed track 456 is in the work position where the drill 460 is aligned with the stinger/centralizer 451 as shown in FIG. 10, the bolt driver carriage disabling surface 472 engages a bolt driver carriage stop surface 478 on the bolt driver carriage 464. The engagement of the bolt driver carriage disabling surface 472 with the bolt driver carriage stop surface 478 prevents motion of the bolt driver carriage 464 along the bolt driver feed track 462. Similarly, when the turret 452 is pivoted to place the bolt driver feed track 462 in the work position, where the bolt driver 466 is aligned with the stinger/centralizer 451 as shown in FIG. 11, the drill carriage disabling surface 476 engages a drill carriage stop surface 480 on the drill carriage 458. The engagement of the drill carriage disabling surface 476 with the drill carriage stop surface 480 prevents motion of the drill carriage 458 along the drill feed track 456.

By blocking the carriage (458 or 464) which is inactive, a single mechanism can be employed for advancing both the drill 460 and the bolt driver 466. One such mechanism is taught in U.S. Pat. Nos. 4,473,325 and 4,497,378, incorporated herein by reference. The carriage stop member 468 provides a passive mechanism for disabling the non-active tool carriage (458 or 464), eliminating the need for an active mechanism to perform such a function and thereby reducing maintenance and increasing reliability of the rock bolter 450.

Figure 12:
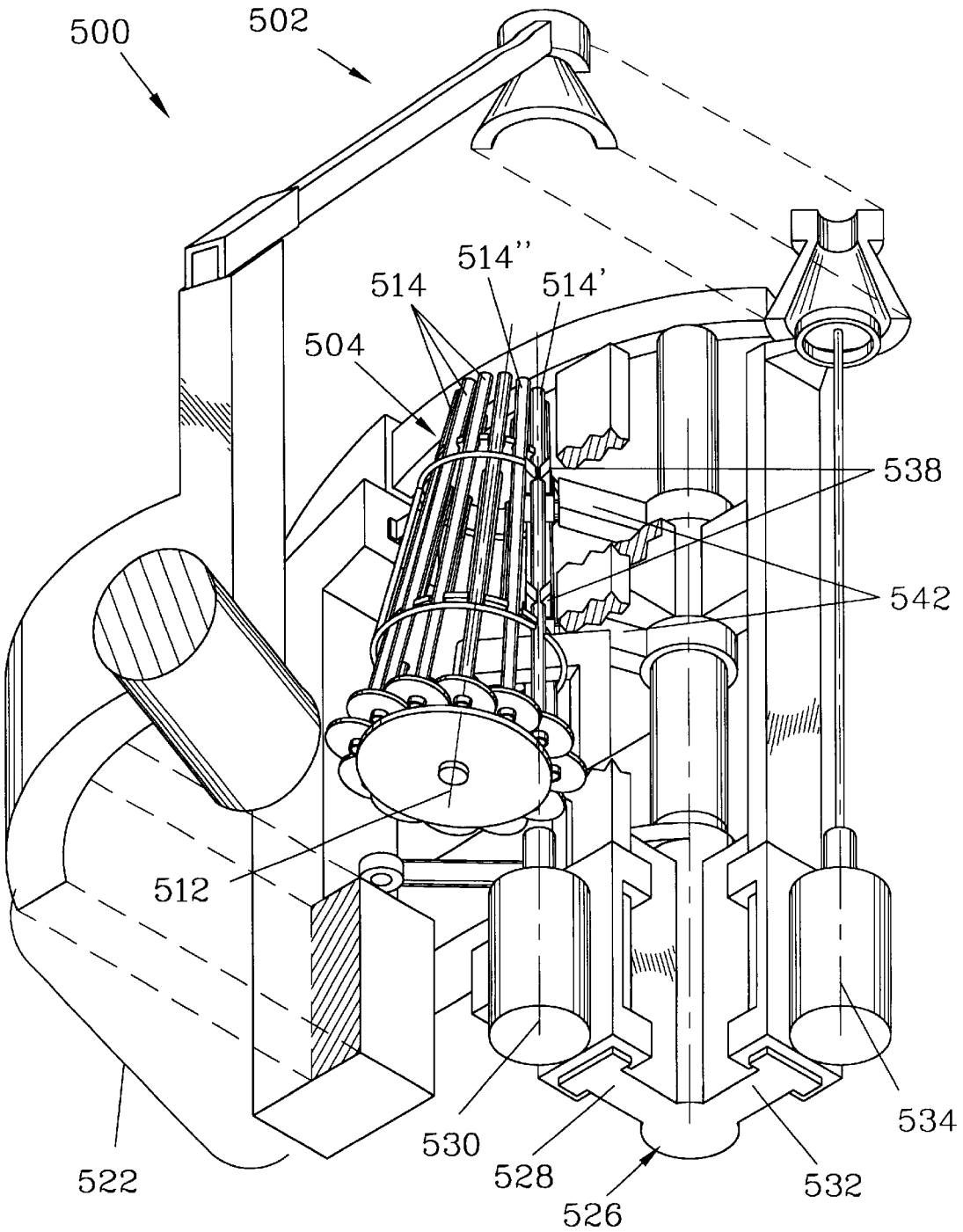
FIG. 12 is an isometric view of an embodiment of the rock bolter of the present invention which has a frusto-conical bolt magazine having multiple bolt cradles. The bolt magazine rotates about a magazine axis which is fixed with respect to the turret axis and aligned such that one of the bolt cradles is aligned with the bolt driver axis when the turret is at or near the drilling position. Bolt-engaging hands are provided which accept a bolt from the aligned bolt cradle of the bolt magazine. The bolt held by the bolt-engaging hands is then removed from the bolt magazine as the turret is rotated to the bolt setting position. The rock bolter is shown in the drilling position in FIG. 12. In this position, as the bolt magazine is advanced, a bolt is advanced into the bolt-engaging hands. The bolt-engaging hands clampably engage the bolt advanced thereinto and maintain the bolt aligned with the bolt driver axis, as well as preventing axial motion of the bolt, as the bolt driver is moved to the work axis.
Figure 13:
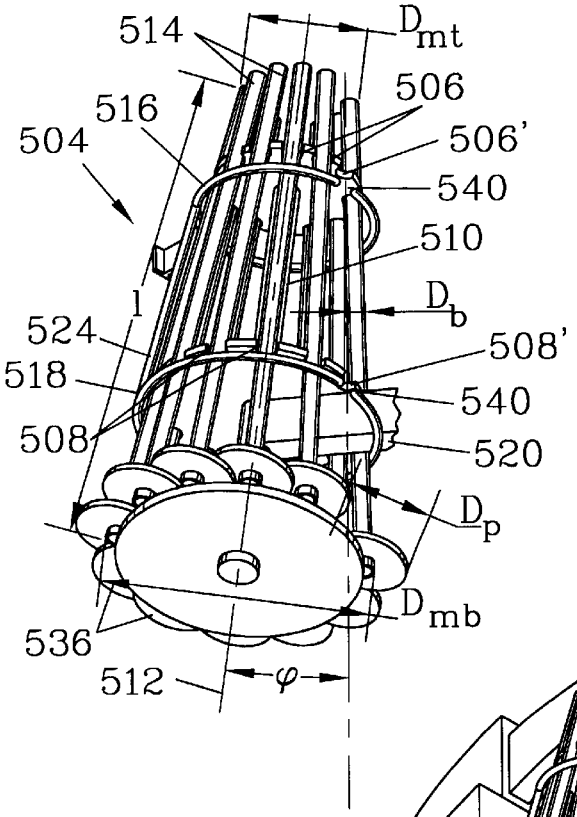
FIG. 13 is an isolated view of the frusto-conical bolt magazine shown in FIG. 12 after one of the bolts has been removed therefrom.
Figure 14:
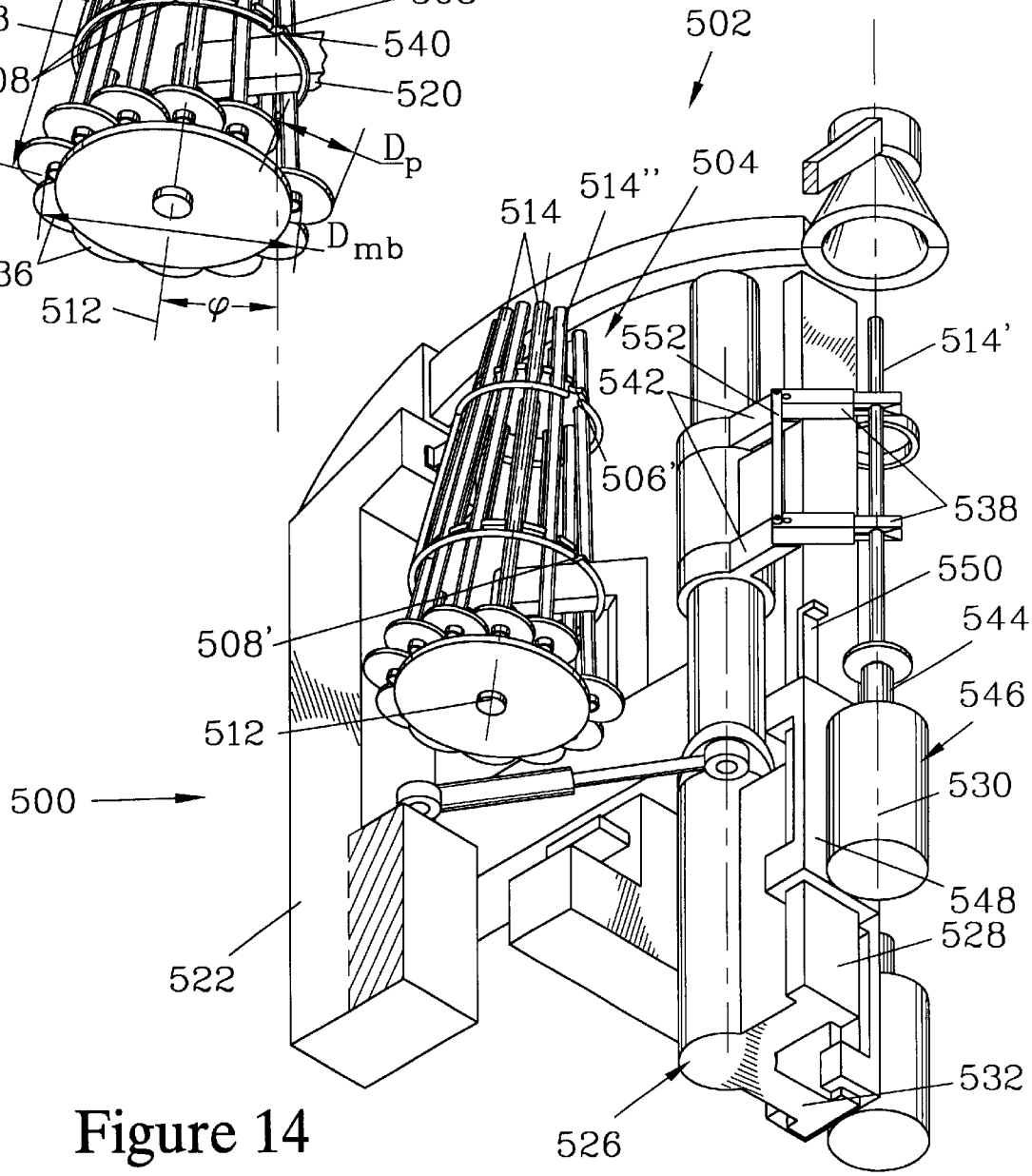
FIG. 14 is an isometric view of the embodiment shown in FIG. 12, where the turret has been pivoted to the bolt driving position. The bolt-engaging hands which are attached to the turret swing the bolt into alignment with the work axis as the turret pivots to swing the bolt driver feed track into the work position.
Figure 15:
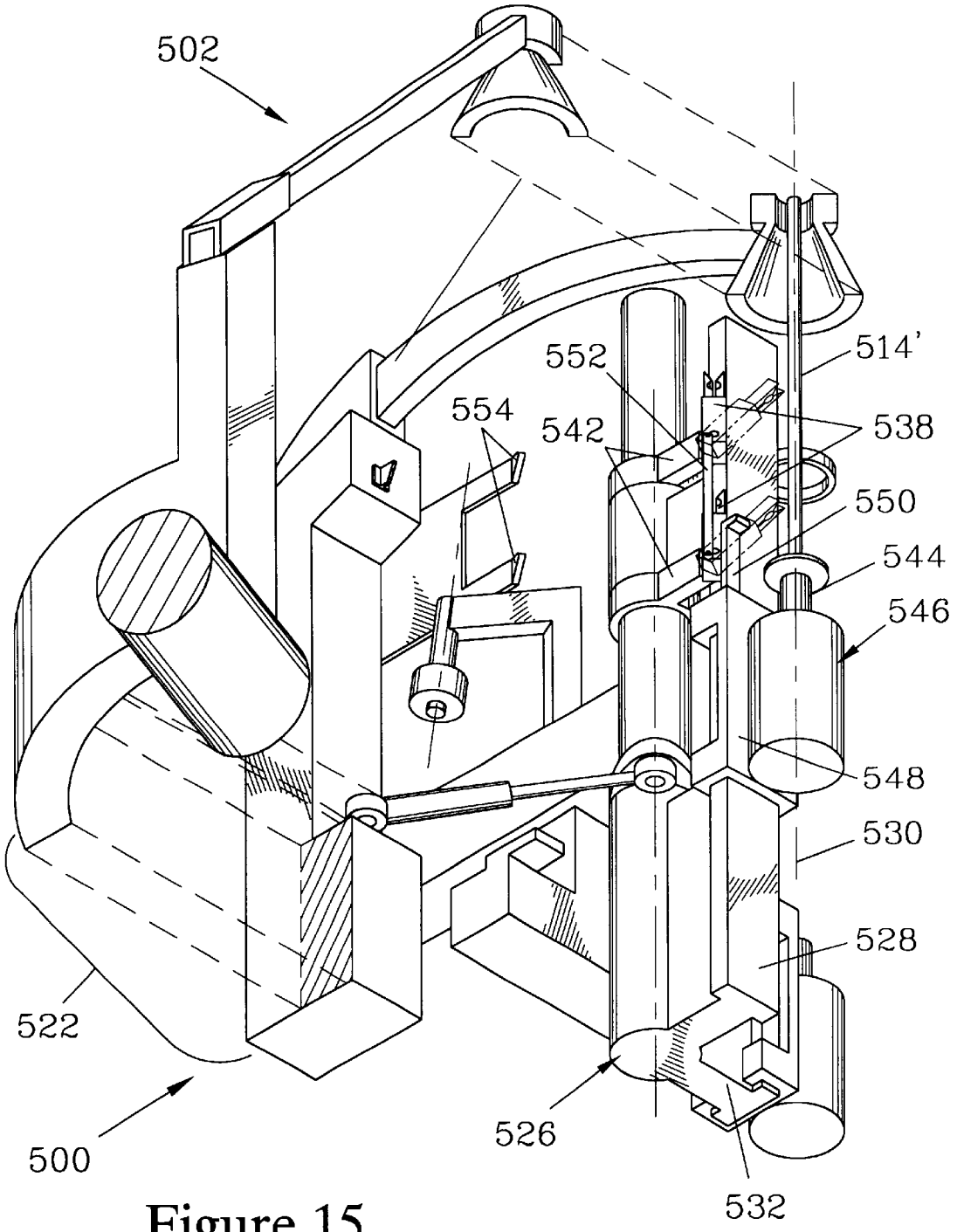
FIG. 15 is an isometric view showing the embodiment shown in FIGS. 12 and 14, with the bolt magazine omitted. As illustrated, the bolt driver is aligned with the work axis and the bolt driver has been advanced toward a stinger/centralizer a sufficient distance for the bolt to be engaged by the bolt driver and advanced into the centralizer. The bolt driver has been further advanced such that a hand-deactivating protrusion engages one of the bolt-engaging hands and moves the bolt-engaging hands toward bolt driver by-pass positions where they are disengaged from the bolt.
Figure 16:
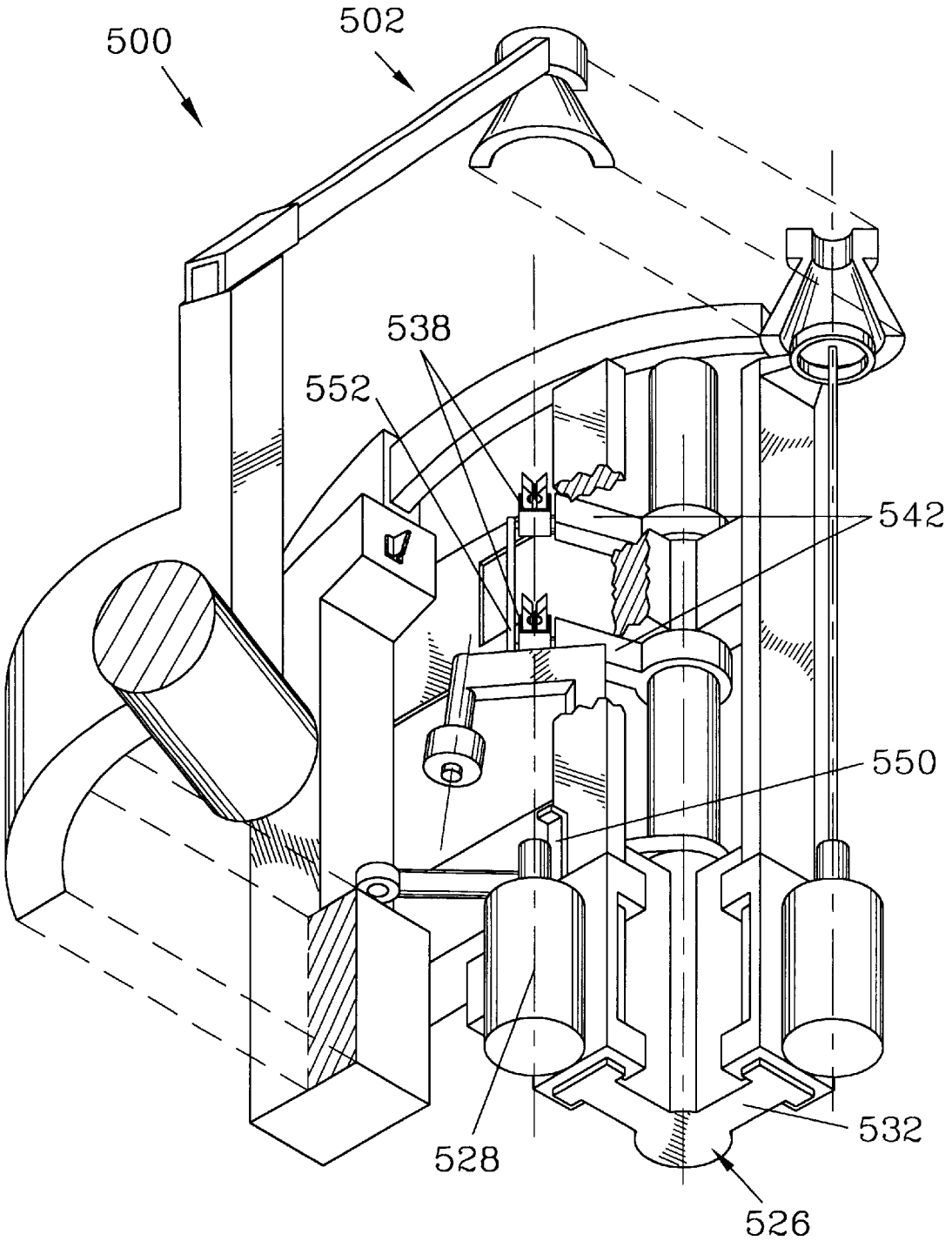
FIG. 16 is an isometric view showing the embodiment shown in FIG. 15, where the turret has been pivoted from the bolt setting position shown in FIGS. 14 and 15 back to the drilling position shown in FIG. 12. A pair of toggling ramps engage the bolt-engaging hands and move the bolt-engaging hands to bolt-holding positions where they are again ready to receive a bolt from the bolt magazine. The magazine is again omitted for clarity.

FIGS. 12–14 illustrate a rock bolter 500 having a stinger/centralizer 502 and employing a cylindrical-type bolt magazine 504 which has particular utility for use with the dual feed track stinger/centralizer rock bolters described above. FIGS. 15 and 16 illustrate the same stinger/centralizer 502 with the bolt magazine 504 removed.

Referring to FIG. 13, the bolt magazine 504 of this embodiment is frusto-conical in shape and has a series of radially arranged upper bolt cradles 506 and a series of radially arranged lower bolt cradles 508, which are symmetrically disposed about a magazine shaft 510 which extends along a central magazine axis 512 of the magazine 504. These bolt cradles (506 and 508) are configured to support a number of bolts 514. The bolts 514 are further supported and maintained in the bolt cradles (506 and 508) by an upper bolt retaining ring 516 and a lower bolt retaining ring 518. A magazine support 520, to which the magazine shaft 510 is rotatably mounted, attaches to a base 522 as is illustrated in FIGS. 12 and 14. The bolt magazine 504 rotates about the central magazine axis 512. The upper bolt retaining ring 516 and the lower bolt retaining ring 518 are supported by a ring support member 524 which in turn is attached with respect to the base 522.

As shown in FIGS. 12 and 14, a turret 526 is also mounted to the base 522. The turret 526 supports a bolt driver feed track 528, having a bolt driver axis 530 associated therewith, and a drill feed track 532, having a drill axis 534 associated therewith. The bolt magazine 504 is mounted to the base 522 such that, when the drill feed track 532 is at or near a work position as is shown in FIG. 12 and a bolt 514' is located in the bolt cradles (506' and 508') in closest proximity to the bolt driver axis 530, the bolt 514' resides on the bolt driver axis 530. The bolt 514' residing in the bolt cradles (506' and 508') can be aligned with the bolt driver axis 530 either when the turret 526 is positioned with the drill feed track 532 in the work position, or when the turret 526 has been slightly rotated to move the bolt driver feed track 528 toward the work position.

The bolt magazine 504 is frusto-conical in shape to provide a reduced footprint of the rock bolter 500 for its components which are in the vicinity of a rock surface into which the bolts 514 are to be driven. Referring again to FIG. 13, the frusto-conical shape of the bolt magazine 504 is, for the most part, determined by the number and size of the bolts 514 to be loaded therein, as well as the size of bolt plates 536 employed with the bolts 514. To minimize the area of the bolt magazine 504 in the vicinity of the stinger/centralizer 502 and to provide a compact structure, the bolts 514 are spaced as closely as practical. Thus, the bolt magazine 504 has a minimum magazine top diameter $D_{mt}$ which is dependent on a bolt diameter $D_b$ of the bolts 514 and the number n of the bolts 514. Since the minimum circumference is roughly equal to the product of the number n and the bolt diameter $D_b$, the minimum magazine top diameter $D_{mt}$ is given by the following formula:

$$D_{mt} \approx (n \times D_b)/\pi \qquad \text{(Equation 1)}$$

The bolt magazine 504 also has a minimum magazine base diameter $D_{mb}$ which is dependent on the bolt diameter $D_b$ and the number n, but which is also dependent on an effective bolt plate diameter $D_p$ of the bolt plates 536, which limit how closely the bolts 514 can be placed. It should be noted that the bolt plates 536 are frequently square in shape, in which case the effective bolt plate diameter $D_p$ is roughly equal to the length of the sides of the square. To prevent interference, the bolt plates 536 limit the center-to-center spacing of the bolts 514 to $(D_p/2)-(D_b/2)$, which can be simplified as $(D_p-D_b)/2$. Since the center-to-center spacing and number n of the bolts 514 determines the minimum circumference, the minimum magazine base diameter $D_{mb}$ is given by the following formula:

$$D_{mb}=(n\times(D_p-D_b))/2\pi \quad \text{(Equation 2)}$$

It should be noted that the first and last of the bolts 514 loaded into the bolt magazine 504 may 10 need a somewhat larger spacing to accommodate magazine mounting elements, such as the magazine support 520, passing therebetween. Such increased separation may be readily provided by substituting (n+1) for n in the above equations, with the space calculated for the additional bolt serving as space between the first and last bolts 514 for accommodating the mounting elements. Preferably, such mounting elements include the magazine support 520 affixed to the base 522, to which the bolt magazine 504 is rotatably mounted, and an anti-rotation latch which is detachably mounted to the base 522 and which is affixed with respect to one end of a rotary actuator, the other end of which is affixed to the bolt magazine 504 to advance the bolts 514. Such mounting elements are known in the art, and allow loading the bolts 514 into the bolt magazine 504 without powered activation of the rotary actuator.

The bolts 514 have a bolt length 1, and the bolts 514 define the side of the frusto-conical shape of the bolt magazine 504. Accordingly, it can be seen that the bolts 514 are inclined with respect to the central magazine axis 512 by an angle $\phi$. The angle $\phi$ is defined by the magazine top diameter $D_{mt}$, the magazine base diameter $D_{mb}$, and the bolt length l. according to the following trigonometric relationship:

$$\sin\phi=(D_{mb}-D_{mt})/2\times l \quad \text{(Equation 3)}$$

As noted above, the bolt magazine 504 is mounted to the base 522 such that, when the drill feed track 532 is at or near a work position as is shown in FIG. 12, the bolt 514' resides on the bolt driver axis 530. To align the bolt 514' with the bolt driver axis 530, the bolt magazine 504 is mounted to the base 522 such that the central magazine axis 512 is inclined with respect the bolt driver axis 530 by the angle $\phi$.

Referring again to FIGS. 12 and 14, bi-modal bolt-engaging hands 538 are provided to grippably engage the bolt 514' when it resides on the bolt driver axis 530 and to maintain the bolt 514' thereon as the turret 526 pivots to pass the bolt 514' through bolt exit passages 540, which are provided in the upper bolt retaining ring 516 and the lower bolt retaining ring 518. As noted above. the bolt 514' residing in the bolt cradles (506' and 508') can be aligned with the bolt driver axis 530 when the turret 526 is slightly rotated to move the bolt driver feed track 528 toward the work position. In such cases, while the drill feed track 532 is in the work position, the bolt magazine 504 advances the bolt 514' to a position where it can be grippably engaged by the bolt-engaging hands 538 as the turret 526 is rotated to move the bolt driver feed track 528 to the work position. However, it is preferred for the bolt magazine 504 to advance the bolt 514' completely into grippable engagement with the bolt-engaging hands 538 when the turret 526 is positioned to place the drill feed track 532 in the work position. In either case, the pivoting action of the turret 526 results in the bolt driver axis 530 moving away from the upper bolt cradle 506' and the lower bolt cradle 508' after the bolt 514' is grippably engaged by the bolt-engaging hands 538.

In FIGS. 12 and 14, the bolt-engaging hands 538 are shown in a bolt-holding position where they are positioned to engage and provide support to the bolt 514' as the bolt magazine 504 is advanced to rotate the bolt 514' into grippable engagement by the bolt-engaging hands 538, when the turret is in its drilling position (shown in FIG. 12). The bolt-engaging hands 538 are pivotably mounted to hand arms 542, which in turn are affixed with respect to the turret 526 and pivot with the bolt driver feed track 528 as the turret 526 swings the bolt driver feed track 528 to the work position, illustrated in FIG. 14. As the turret 526 rotates, the bolt-engaging hands 538 carry the bolt 514' out of the bolt magazine 504 and into alignment with the stinger/centralizer 502. The bolt-engaging hands 538 not only maintain the bolt 514' aligned on the bolt driver axis 530, but also clamp the bolt 514' to prevent axial motion of the bolt 514'.

The bolt-engaging hands 538 remain in the bolt-holding position, where they clampably support the bolt 514', until such time as the bolt 514' is supported by the stinger/centralizer 502 and by a bolt-engaging head 544 of a bolt driver 546 which is advanced along the bolt driver feed track 528. At such time, the bolt-engaging hands 538 are pivoted about the hand arms 542 to a bolt driver by-pass position shown in FIG. 15. In the bolt driver by-pass position, the bolt-engaging hands 538 are disengaged from the bolt 514' and are positioned such that both the bolt driver 546 and a bolt diver carriage 548 on which the bolt driver 546 rides can pass thereby. FIG. 15 also shows, in phantom, the bolt-engaging hands 538 in an intermediate position where they have been removed from the bolt 514' and are in transition between the bolt-holding position and the bolt driver by-pass position.

A hand-deactivating protrusion 550 is provided which serves as means for toggling the bolt-engaging hands 538 from the bolt-holding position to the bolt driver by-pass position. In this embodiment. the hand-deactivating protrusion 550 is provided on the bolt driver carriage 548 onto which the bolt driver 546 is mounted. As the bolt driver carriage 548 is advanced along the bolt driver feed track 528, the hand-deactivating protrusion 550 engages one of the bolt-engaging hands 538 and pivots it to the bolt driver by-pass position after such time as the bolt 514' is engaged by the bolt-engaging head 544 of the bolt driver 546. The other of the bolt-engaging hands 538 is pivoted to the bolt driver by-pass position after such time as the bolt 514' has been advanced into the stinger/centralizer 502. To pivot the other of the bolt-engaging hands, the bolt-engaging hands 538 can be connected so as to act synchronously. In this embodiment, the bolt-engaging hands 538 are both pivotably connected to a linkage 552. The linkage 552 causes both bolt-engaging hands 538 to pivot synchronously, so that the action of pivoting one bolt-engaging hand 538 by the hand-deactivating protrusion 550 causes the other bolt-engaging hand 538 to also pivot. Since the bolt-engaging hands 538 tightly grip the bolt 514' when in the bolt-holding position, removing both bolt-engaging hands 538 simultaneously minimizes wear on the bolt-engaging hands 538 due to vibration of the bolt 514'. This is particularly desirable when the bolt driver 546 is a percussion-type bolt driver. However, synchronous pivoting of the bolt-engaging hands 538 requires the bolt-engaging hands 538 to be positioned such that the hand-deactivating protrusion 550 engages the first of the bolt-engaging hands 538 after the bolt 514' is both engaged by the bolt-engaging head 544 of the bolt driver 546 and advanced into the stinger/centralizer 502.

As the turret 526 is rotated to return the drill feed track 532 to the work position, as shown in FIG. 16, the bolt-engaging hands 538 are returned to their bolt-holding position so as to be properly positioned to grippably engage the next bolt 514" (shown in FIGS. 12–14) from the bolt magazine 504 as the bolt 514" is advanced thereinto. In this embodiment, a pair of hand-reactivating ramps 554 (best shown in FIG. 15) are mounted in a fixed relationship with respect to the base 522. The hand-reactivating ramps 554 are positioned to urge the bolt-engaging hands 538 to pivot back to their bolt-holding positions as the turret 526 is rotated to return the drill feed track 532 to the work position and to return the bolt driver axis 530 into position to receive the next bolt 514".

Figure 17:
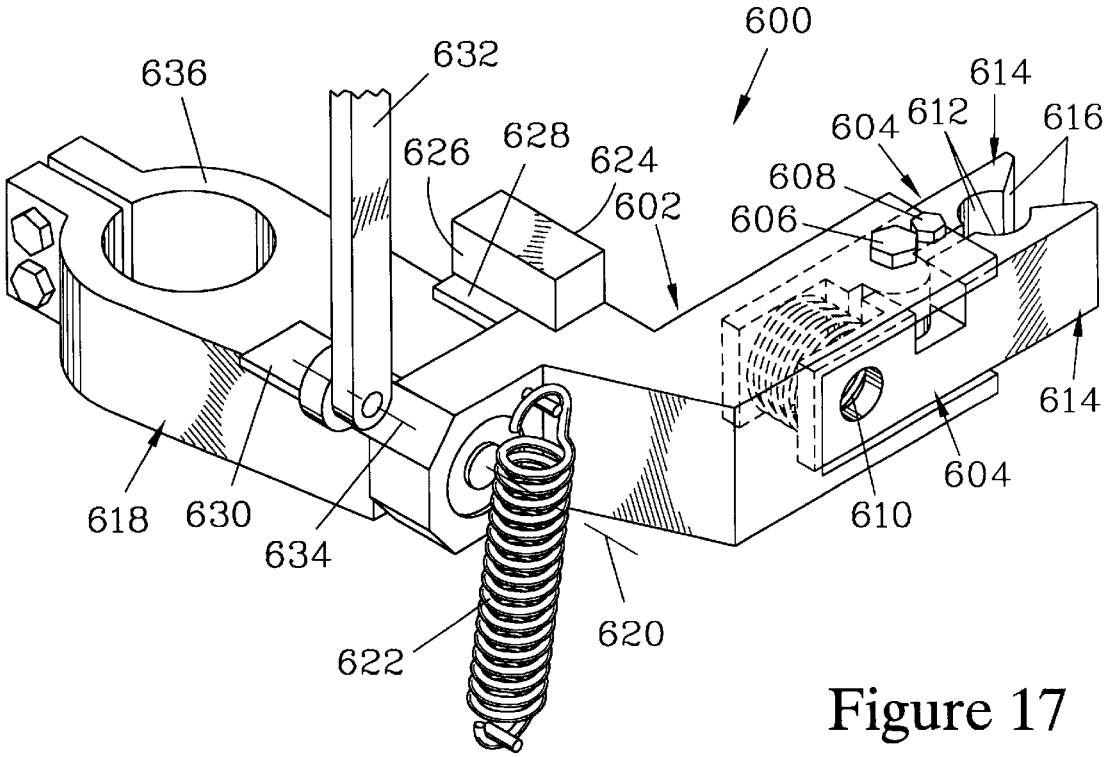
FIG. 17 is an isometric view showing a preferred configuration for a bolt-engaging hand and arm assembly suitable for use in the embodiment shown in FIGS. 12–16, where the action of the bolt-engaging hands is synchronized. The bolt-engaging hand is shown in a bolt-holding position.

FIG. 17 illustrates a preferred bolt-engaging hand 600 which can be employed in the embodiment shown in FIGS. 12–16. The bolt-engaging hand 600 has a hand body 602, to which a pair of bolt-engaging fingers 604 are pivotably mounted by means of a pivot bolt 606. Additionally, an anti-swivel bolt 608 is provided in the hand body 602 to limit the pivoting of the bolt-engaging fingers 604 with respect to the hand body 602. The pair of bolt-engaging fingers 604 are biased by a compression spring 610. The bolt-engaging fingers 604 each have a bolt-receiving cavity 612, which is sized such that a bolt (not shown) residing in the bolt receiving cavity 612 of the bolt-engaging fingers 604 is firmly clamped by the bias of the compression spring 610, preventing both axial and non-axial motion of the bolt. Accordingly, the bolt receiving cavities 612 are sized for a particular bolt diameter Db. If different bolts having a different bolt diameter $D_b$ are to be employed, such can be accomplished by replacing the bolt-engaging fingers 604 with alternative bolt-engaging fingers which have bolt receiving cavities properly sized for the different bolts.

Each of the pair of bolt-engaging fingers 604 also has a finger tip region 614 which is provided with a sloped surface 616. The sloped surfaces 616 guide the bolt into the bolt-receiving cavities 612. The bolt can be advanced into the bolt-receiving cavities 612 by a bolt magazine (not shown), such as the bolt magazine 504 discussed above, in cases where the bolt cavities 612 are initially aligned with a bolt driver axis. As the bolt is advanced, it engages the sloped surfaces 616 and moves the bolt-engaging fingers 604 against the bias of the compression spring 610 to allow the bolt to pass by the finger tip regions 614 to be accepted into the bolt-receiving cavities 612. Alternatively, the bolt magazine may advance the bolt only into a position for engagement with the sloped surfaces 616. In this case, as a turret (not shown) is pivoted to move the bolt driver axis to a work position, the sloped surfaces engage the bolt to move the bolt-engaging fingers 604 against the bias of the compression spring 610, allowing the finger tip regions 614 to pass the bolt and allowing the bolt-receiving cavities 612 to be moved into engagement around the bolt, at which point further pivoting of the turret removes the bolt from the bolt magazine.

The hand body 602 of the bolt-engaging hand 600 is pivotably mounted with respect to a hand arm 618 so as to be pivotable about a hand pivot axis 620 between a bolt-holding position and a bolt driver by-pass position. A tension spring 622 is connected at one end to the hand body 602 and at the other end with respect to the hand arm 618. To provide a substantial length for the tension spring 622, it is preferred to attach the other end of the tension spring 622 to the turret to which the hand arm 618 is mounted. The tension spring 622 is stretched to a maximum length when the hand body 602 is between the bolt-holding position and the bolt driver by-pass position, and thus serves to bias the hand body 602 to one of these positions. In the bolt-engaging hand 600, the hand body 602 is provided with a bolt-holding position stop surface 624 and a by-pass position stop surface 626. When the hand body 602 is biased by the tension spring 622 to the bolt-holding position, the bolt-holding position stop surface 624 engages a bolt-holding position bearing surface 628 provided on the hand arm 618. Similarly, when the hand body 602 is biased by the tension spring 622 to the bolt driver by-pass position, the by-pass position stop surface 626 engages a by-pass position bearing surface 630 provided on the hand arm 618.

To allow the bolt-engaging hand 600 to move synchronously with a second bolt-engaging hand (not shown), a linkage rod 632 is connected to the hand body 602 at a location spaced apart from the hand pivot axis 620. The linkage rod 632 is pivotably attached to the hand body 602 so as to pivot with respect thereto about a linkage pivot axis 634 which is spaced apart from and substantially parallel to the hand pivot axis 620.

To provide a degree of adjustability in the positioning of the bolt-engaging hand 600, it is preferred for the hand arm 618 to be provided with a turret-engaging bracket 636 which allows the hand arm 618 to be attached to a cylindrical member of the turret and to be rotatably adjusted with respect thereto about an associated turret pivot axis.

While it is frequently desirable to synchronize the action of the bolt-engaging hands, such synchronization limits the positioning of the bolt-engaging hands, as noted above. To maintain alignment of the bolt, it is necessary to position the bolt-engaging hands such that the bolt grippably engaged therein is advanced into the centralizer passage before such time as both of the bolt-engaging hands are rotated to their bolt driver by-pass positions. In cases where it is desirable to position one of the bolt-engaging hands such that it is rotated to its bolt driver bypass position before the bolt is advanced into the centralizer passage, rotating the bolt-engaging hands independently allows the other bolt-engaging hand to continue to stabilize the bolt as the bolt driver passes the first bolt-engaging hand to advance the bolt into the centralizer passage. While independent rotation of the bolt-engaging hands allows greater freedom in placement of the bolt-engaging hands, such is accomplished at the expense of increased wear of the bolt-engaging hands.

Figure 18:
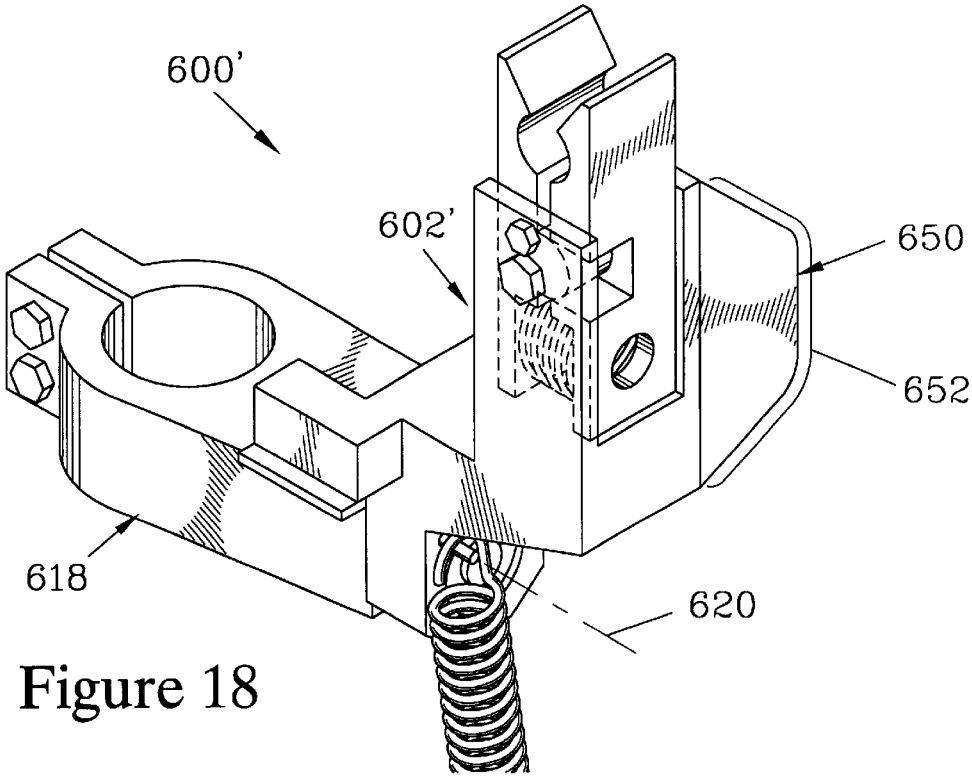
FIG. 18 is an isometric view of an alternative bolt-engaging hand which shares many features in common with the bolt-engaging hand shown in FIG. 17, but where the action of the bolt-engaging hands is not synchronized. The bolt-engaging hand is shown in a bolt driver by-pass position.

FIG. 18 illustrates an alternative bolt-engaging hand 600' which can be employed in place of the bolt-engaging hand 600 discussed above. The bolt-engaging hand 600' is well suited to use when the bolt-engaging hands 600' rotate independently about their respective hand arms 618. The bolt-engaging hand 600' has a hand cam member 650 attached to the hand body 602'. The hand cam member 650 has a hand cam surface 652 thereon, which is positioned to be engaged by a bolt driver carriage (not shown) as the bolt driver carriage is advanced along a bolt drive feed track. The hand cam surface 652 is configured to be forcibly engaged by the bolt driver carriage so as to pivot the hand body 602' with respect to the hand arm 618 about the hand pivot axis 620 from the bolt-holding position to the bolt driver by-pass position (illustrated) as the bolt driver carriage is further advanced along the bolt driver feed track. The hand cam member 650 is particularly advantageous when the bolt driver carriage is not provided with a hand-deactivating protrusion such as the hand-deactivating protrusion 550 shown in FIGS. 12–16.

While hand cam member 650 is particularly well suited for use with the bolt-engaging hand 600' which rotates independently about the hand arm 618, it should be appreciated that the hand cam member 650 could also be employed on the bolt-engaging hand 600 discussed above, where the bolt-engaging hand 600 moves synchronously with a second bolt-engaging hand. In such a case, only the bolt-engaging hand 600 which is positioned furthest from a stinger/centralizer is provided with the hand cam member 650, since the second bolt-engaging hand is moved to its bolt driver by-pass position before the bolt driver carriage or hand-deactivating protrusion can be advanced into engagement therewith.

While the novel features of the present invention have been described in terms of particular embodiments and preferred applications, it should be appreciated by one skilled in the art that substitution of materials and modification of details obviously can be made without departing from the spirit of the invention.

What we claim is:

1. An improved rock bolter mounted to a boom for drilling holes into a rock surface and setting bolts therein, the improved rock bolter having, a base for attachment to the boom, the base being designed for supporting a stinger/centralizer which is symmetrically disposed about a work axis, a drill feed track which is traversed by a rock drill having an associated drill axis, a bolt driver feed track which is traversed by a bolt driver having an associated bolt driver axis, a turret having a turret axis about which the turret pivots with respect to the base, the turret axis being parallel to but displaced from the work axis, the drill feed track being attached to the turret such that the drill axis is parallel to but spaced apart from the turret axis, and the bolt driver feed track being attached to the turret such that the bolt driver axis is parallel to but spaced apart from the turret axis and the drill axis, and means for pivoting the turret between a drilling position, where the drill axis is aligned with the work axis, and a bolt setting position, where the bolt driver axis is aligned with the work axis, the improvement comprising:

a first head element having a rock engaging surface thereon for engaging the rock surface and having a first head cavity therein;

a first head arm attached to said first head element;

a first head arm mount attached to the base, said first head arm being translatably engaged with said first head arm mount;

means for advancing and retracting said first head arm with respect to said first head arm mount;

means for guiding said first head arm such that said first head element traverses a first head curvilinear path;

a second head element having a second head cavity therein;

a second head arm attached to said second head element;

a second head arm mount attached to the base, said second head arm being translatably engaged with said second head arm mount;

means for advancing and retracting said second head arm with respect to said second head arm mount;

means for guiding said second head arm such that said second head element traverses a second head curvilinear path; and means for engaging said first head element with said second head element so as to form a head assembly, said first head cavity and said second head cavity being configured to provide a centralizer passage having a centralizer axis which is coincident with the work axis when said first head element and said second head element are so engaged.

2. The improved rock bolter of claim 1 wherein said means for guiding said first head arm is such that said first head element traverses a substantially linear path to and from an extended position where said first head element is positioned to contact the rock surface.

3. The improved rock bolter of claim 2 further comprising:

a supplementary stinger having, a stinger body affixed with respect to the base, an extendable member terminating in a rock engaging end, said extendable member movably engaging said stinger body, and means for extending said extendable member with respect to said stinger body.

4. The improved rock bolter of claim 3 wherein said stinger body is affixed to said first head arm mount.

5. The improved rock bolter of claim 4 wherein said means for extending said extendable member further comprises:

a supplementary stinger linear actuator having a supplementary stinger actuator first end attached to said extendable member and a supplementary stinger actuator second end attached to said stinger body.

6. The improved rock bolter of claim 2 wherein said means for guiding said first head arm such that said first head element traverses a first head curvilinear path further comprises:

at least a pair of spaced apart first arm guide surfaces on said first head arm;

at least a pair of spaced apart first arm directing elements mounted to said first head arm mount and contoured to engage said spaced apart first arm guide surfaces so as to direct said first head arm to move said first head element along said substantially linear path; and further wherein said means for advancing and retracting said first head arm further comprises:

a first linear actuator connected to said first head arm and to the base; and still further wherein said means for guiding said second head arm such that said second head element traverses a second head curvilinear path further comprises:

at least a pair of spaced apart second arm guide surfaces on said second head arm;

at least a pair of spaced apart second arm directing elements mounted to said second head arm mount and contoured to engage said spaced apart second arm guide surfaces so as to direct said second head arm to move said second head element along said second head curvilinear path; and yet further wherein said means for advancing and retracting said second head arm further comprises:

a second linear actuator connected to said second head arm and to the base.

7. The improved rock bolter of claim 6 wherein said second head curvilinear path is an inflected.

8. The improved rock bolter of claim 7 wherein all of said guide surfaces slidably engage said directing elements.

9. The improved rock bolter of claim 1 wherein said first head element has a substantially planar first mating surface and said second head element has a substantially planar second mating surface, said first head element and said second head element forming said head assembly when said first mating surface and said second mating surface are joined, and further wherein said centralizer passage of said head assembly has, a substantially cylindrical section which terminates at said rock engaging surface of said first head element, and a frusto-conical guide section axially aligned with said substantially cylindrical section and extending through the remainder of said head assembly.

10. The improved rock bolter of claim 9 wherein all edges between said first head cavity and said first mating surface and between said second head cavity and said second mating surface are chamfered.

11. The improved rock bolter of claim 9 wherein said head assembly further comprises:

a stabilizing protrusion affixed with respect to one of said first head element and said second head element, the other of said first head element and said second head element having receptor guide surfaces affixed with respect thereto, said receptor guide surfaces being guidably engageable with said stabilizing protrusion so as to guide said other of said first head element and said second head element into engagement with said one of said first head element and said second head element such that said first head cavity and said second head cavity form said centralizer passage.

12. The improved rock bolter of claim 11 wherein said stabilizing protrusion is a key formed on one of said first head element and said second head element, the other of said first head element and said second head element having a keyway provided thereon, said key and said keyway being configured to guidably engage each other as said first head element advances toward said second head element.

13. The improved rock bolter of claim 12 wherein the rock bolter is intended to be operated where said second arm is extended before said first arm and said first head arm sweeps out a path parallel to a first arm sweep plane, and further wherein said first mating surface and said second mating surface are substantially normal to said first arm sweep plane.

14. The improved rock bolter of claim 1 wherein said centralizer passage of said head assembly formed by said first head element and said second head element has a frusto-conical guide section symmetrically disposed about said centralizer axis, and further wherein the drill feed track terminates in a proximal end region located in the vicinity of the rock surface and the drill is provided with a drill steel which extends substantially along the drill axis, the improved rock bolter further comprising:

a drill steel retaining ring alignable with the drill axis and positionable at the proximal end region of the drill feed track, said drill steel retaining ring being sized with respect to said frusto-conical guide section of said centralizer passage so as to maintain the drill steel within a cylinder projected from said frusto-conical guide section along said work axis when the turret is in the drilling position.

15. The improved rock bolter of claim 14 wherein said drill steel retaining ring is mounted to the proximal end region of the drill feed track.

16. The improved rock bolter of claim 1 wherein the rock bolter has a bolt magazine for carrying bolts, the bolt magazine having, a first series of radially arranged bolt cradles attached to a magazine shaft and symmetrically disposed about a magazine axis, a second series of radially arranged bolt cradles attached to the magazine shaft and symmetrically disposed about the magazine axis, a first bolt retaining ring having a first bolt exit passage and a second bolt retaining ring having a second bolt exit passage, the first bolt retaining ring and the second bolt retaining ring being affixed with respect to the magazine axis such that bolts can be slidably engaged between the bolt cradles and the bolt retaining rings, the bolt exit passages being positioned such that a bolt positioned behind the bolt exit passages resides on the bolt driver axis when the turret is at or near the drilling position, a bolt headrest plate axially aligned with the magazine axis, and means for maintaining the bolt residing on the bolt driver axis in position, the improvement being maintaining the geometry of the components so as to provide a frusto-conical bolt magazine.

17. The improved rock bolter of claim 16 wherein the means for maintaining the bolt residing on the bolt driver axis in position further comprises:

a pair of bolt-engaging hands, each of said bolt-engaging hands being configured to accept the bolt positioned behind the bolt exit passages as the bolt is rotated into alignment with the bolt driver axis when the turret is in the drilling position, each of said bolt-engaging hands being configured to grippably engage the bolt and being mounted to the turret so as to pivot with the turret to maintain the bolt aligned with the bolt driver axis; and means for removing the bolt from grippable engagement by one of said pair of bolt-engaging hands when the bolt driver is advanced along the bolt driver feed track sufficiently to engage the bolt, and for removing the bolt from grippable engagement by the other of said pair of bolt-engaging hands when the bolt driver is advanced along the bolt driver feed track sufficiently to advance the bolt into said centralizer passage.

18. The improved rock bolter of claim 17 wherein said bolt-engaging hands are pivotably mounted to hand arms which in turn are affixed to the turret, further wherein said means for removing the bolt from grippable engagement further comprises:

a hand deactivating protrusion mounted with respect to the bolt driver, said hand deactivating protrusion being configured to forcibly engage said one of said bolt-engaging hands and pivot said one of said bolt-engaging hands with respect to a corresponding one of said hand arms to a bolt driver by-pass position where said one of said bolt-engaging hands is removed from the one of the bolts and where the bolt driver can be advanced along the bolt driver feed track without interference with said one of said bolt-engaging hands;

a linkage between said pair of bolt-engaging hands which causes said pair of bolt-engaging hands to pivot synchronously about their respective hand arms, whereby said other of said pair of bolt-engaging hands is pivoted to a similar bolt driver by-pass position as said one of said bolt-engaging hands is pivoted to its bolt driver by-pass position; and a hand reactivating protrusion mounted with respect to the base and configured to forcibly engage at least one of said bolt-engaging hands as the turret is rotated to the drilling position and pivot said at least one of said bolt-engaging hands to a bolt holding position where said at least one of said bolt-engaging hands is positioned to grippably engage a bolt rotated into alignment with the bolt driver axis.

19. An improved rock bolter having a stinger/centralizer attached to a base, the improvement comprising:

a supplementary stinger having, a stinger body affixed with respect to the base, an extendable member terminating in a rock engaging end said extendable member movably engaging said stinger body, and means for extending said extendable member with respect to said stinger body.

20. The improved rock bolter of claim 19 wherein the stinger/centralizer has a first head arm mount for supporting a first head arm with respect to the base, the first head arm mount being located in close proximity to a boom on which the base is mounted, further wherein said stinger body is affixed to the first head arm mount.

21. The improved rock bolter of claim 20 wherein said means for extending said extendable member further comprises:

a supplementary stinger linear actuator having a supplementary stinger actuator first end attached to said extendable member and a supplementary stinger actuator second end attached to said stinger body.

22. An improved rock bolter mounted to a boom for drilling holes into a rock surface along a desired work axis and setting bolts into the drilled holes, the improved rock bolter having, a base for attachment to the boom, a drill feed track to which a rock drill having an associated drill axis is mounted via a drill carriage, the rock drill moving along the drill feed track to and from a drill withdrawn position, where the rock drill is positioned at a maximum separation from the rock surface, a bolt driver feed track to which a bolt driver having an associated bolt driver axis is mounted via a bolt driver carriage, the bolt driver moving along the bolt driver feed track to and from a bolt driver withdrawn position, where the bolt driver is positioned at a maximum separation from the rock surface, a turret having a turret axis about which the turret pivots with respect to the base, the turret axis being parallel to but displaced from the work axis, the drill feed track being attached to the turret such that the drill axis is parallel to but spaced apart from the turret axis, and the bolt driver feed track being attached to the turret such that the bolt driver axis is parallel to but spaced apart from the turret axis and the drill axis, and means for pivoting the turret between a drilling position, where the drill axis is aligned with the work axis, and a bolt setting position, where the bolt driver axis is aligned with the work axis, the improvement comprising:

a drill carriage disabling surface mounted with respect to the base and so positioned as to engage the drill carriage to prevent motion of the rock drill along the drill feed track when the rock drill is in the drill withdrawn position and the turret is in the bolt setting position; and a bolt driver carriage disabling surface mounted with respect to the base and so positioned as to engage the bolt driver carriage to prevent motion of the bolt driver along the bolt driver feed track when the bolt driver is in the bolt driver withdrawn position and the turret is in the drilling position.

* * * * *